US005240363A

United States Patent [19]

Ito et al.

[11] Patent Number: 5,240,363

[45] Date of Patent: Aug. 31, 1993

[54] IMAGE-FORMING APPARATUS PROVIDED WITH BOOKBINDING DEVICE

[75] Inventors: Yukihiro Ito, Osaka; Yutaka Shigemura, Takarazuka; Takashi Kondo, Sakai; Hideo Umezawa, Amagasaki; Mitsuharu Yoshimoto, Nara; Satoshi Yano, Takatsuki; Junichi Oura, Hirakata, all of Japan

[73] Assignee: Mita Industrial Co., Ltd., Osaka, Japan

[21] Appl. No.: 890,702

[22] Filed: May 29, 1992

Related U.S. Application Data

[62] Division of Ser. No. 583,643, Sep. 17, 1990, Pat. No. 5,143,503.

[30] Foreign Application Priority Data

| | | | |
|---|---|---|---|
| Sep. 28, 1989 | [JP] | Japan | 1-113844 |
| Sep. 28, 1989 | [JP] | Japan | 1-113845 |
| Sep. 28, 1989 | [JP] | Japan | 1-253652 |
| Sep. 28, 1989 | [JP] | Japan | 1-253653 |
| Sep. 28, 1989 | [JP] | Japan | 1-253654 |

[51] Int. Cl.[5] ..... B42C 9/00

[52] U.S. Cl. ..... 412/37; 412/33; 412/900; 355/324; 156/908

[58] Field of Search ..... 412/33, 37, 902, 8, 412/11, 900; 156/908; 355/324

[56] References Cited

U.S. PATENT DOCUMENTS

| | | | |
|---|---|---|---|
| 4,194,832 | 3/1980 | Tabayashi | 355/11 |
| 4,540,458 | 9/1985 | Baughman et al. | 156/312 |
| 4,566,782 | 1/1986 | Britt et al. | 355/14 SH |
| 4,568,172 | 2/1986 | Acquaviva | 355/14 SH |
| 4,818,168 | 4/1989 | Battisti | 412/37 |
| 4,958,974 | 9/1990 | Schenk | 412/37 |

*Primary Examiner*—Mark Rosenbaum
*Assistant Examiner*—S. Thomas Hughes
*Attorney, Agent, or Firm*—Wenderoth, Lind & Ponack

[57] ABSTRACT

An image-forming apparatus is provided with a bookbinding device having a binder receiving portion. The binder receiving portion is provided with a heat source for heating an adhesive or with an electrode for electrifying the electric heating member on a bottom portion thereof so that a plurality of papers disposed in a binder can be adhered to the inner surface of the back cover of the binder by heating and melting the adhesive with the heat source or the electric heating member. The heat source or electrode is swingably mounted in the binder receiving portion for movement between a bookbinding position and a retracted position. An operating mechanism is provided for moving the heat source or electrode from the retracted position to the bookbinding position upon insertion of the binder into the binder receiving portion.

4 Claims, 26 Drawing Sheets

1
2
11
11a
11b
13
17
18
19
20
21
22a
22b
23
24
25
d
e
f

IMAGE-FORMING APPARATUS PROVIDED WITH BOOKBINDING DEVICE

This application is a divisional of application Ser. No. 07/583,643, filed Sep. 17, 1990, now U.S. Pat. No. 5,143,503.

BACKGROUND OF THE INVENTION

1. Field of the Invention

The present invention relates to an image-forming apparatus, such as an electrostatic photographic copying machine and printer, with a bookbinding function to multi-functionalize said image-forming apparatus.

2. Description of the Prior Art

In a conventional bookbinding method illustrated in FIGS. 29, 30(A) and 30(B), a plurality of papers (e) are put in a binder (d) provided with an electric heating member (c) with an adhesive (b) on the side of an inner surface of a back cover (a) thereof. A binder-charged portion (h) is provided with electrodes (f), (f) for electrifying said electric heating member (c), and an electric current is applied to the electric heating member (c) through said electrodes (f), (f) to melt said adhesive (b), whereby said plurality of papers (e) is adhered to said side of the inner surface of said back cover (a) of the binder (d).

In addition, eyelet-like electric current-receiving terminals (i), (i) pass through the electric heating member (c) and the back cover (a) at both end portions of the electric heating member (c) to be exposed on the side of an outer surface of the back cover (a).

In another conventional bookbinding method, an adhesive (b) is merely applied to the side of an inner surface of a back cover (a) of a binder (d) and said adhesive (b) is heated and melted by means of a heat source (j) provided in a binder-charged portion (h) to adhere a plurality of papers (e) to the side of said inner surface of said back cover (a) of said binder (d), as shown in FIGS. 31(A) and 31(B).

However, the above described bookbinding devices have been used exclusively for bookbinding, so that the above described bookbinding devices have been supplied separately from image-forming apparatus, such as electrostatic photographic copying machines and printers. With these separate devices, it is necessary to perform a series of operations in which images are formed by copying and the like and then the papers are separately bound. The use of such separate apparatus has become remarkably uneconomical as a whole, and large installation spaces have been required.

In addition, in the bookbinding devices of this type, it has been remarkably important, when the binder-charged portion (h) is charged, that the back cover (a) of the binder (d) be brought into close contact with the heat source (j), or that the electric current-receiving terminals (i), (i) of the electric heating member (c) be brought into close contact with the electrodes (f), (f). However, it has been a problem that foreign matter, such as dust and paper powder, has entered into the binder-charged portion through a binder-inserting hole, and has become stuck to surfaces where the heat source (j) or the electrodes (f), (f) are engaged with the binder. This has led to the back cover (a) of the binder being brought into poor contact with the heat source (j) and the electric current-receiving terminals (i), (i) being brought into poor contact with the electrodes (f), (f), and thus to a non-uniform and insufficient heating of the adhesive (b).

In particular, the above described tendency of foreign matter to enter into the binder-charged portion has been especially notable in binders in which the binder-inserting hole is formed in an upper portion to charge the binder from above.

On the other hand, in the binder (d) provided with the electric heating member (c) with the adhesive (b) on the side of the inner surface of the back cover (a), the electric heating member (c) is different in length, and thus resistance, for different sized papers. Thus, when a constant electric current is provided for an appointed time, disadvantages have occurred in that the total calorific volume of the electric heating member (c) per unit length for a unit time is greatly changed for different sized papers. For example, with a binder of middle size as the standard, the smaller the binder size is, the more excessive the calorific value is, and the larger the binder size is, the more wanting the calorific value is. Therefore, the desired bookbinding can not be achieved.

SUMMARY OF THE INVENTION

The present invention has been achieved in view of the above described circumstances and it is an object of the present invention to provide a bookbinding function to an image-forming apparatus to solve disadvantages in economy and installation space. In addition, it is another object of a first invention and a second invention to prevent foreign matter from entering a binder-charged (or binder receiving) portion when no bookbinding operation is being performed. It is another object of a third invention to remove foreign matter after it has entered a binder-charged portion and become stuck to surfaces of a heat source or electrodes which are to engage with a binder. It is another object of a fourth invention and a fifth invention to prevent foreign matter, which has entered a binder-charged portion, from being stuck to surfaces where a heat source or electrodes are engaged with a binder, thereby providing an image-forming apparatus capable of preventing non-uniform heating and insufficient heating for adhesives due to poor contact.

And, it is another object of a sixth invention to control an electric heating member so that a total calorific value per unit length can be held almost constant, thereby uniformly heating and melting an adhesive, even for binders of different size.

In order to achieve the above described objects, according to said first to fourth inventions, the respective image-forming apparatus are provided with a binder-charged portion provided with adhesive applied thereto, or an electric heating member with an adhesive formed on an inner surface of a back cover thereof. Said binder-charged portion is provided with a heat source for heating said adhesive or an electrode for electrifying said electric heating member on the bottom portion thereof so that a plurality of papers disposed in a binder may be adhered to said inner surface of the back cover of the binder by heating and melting the adhesives by means of said heat source or said electric heating member.

And, in addition to the above described main construction, in the first invention a binder-inserting hole of the binder-charged portion is provided with a closing cover.

In the second invention, the binder-charged portion is adapted to be movable between a first condition in which it is housed in a binder-charged portion-housing portion and a second condition in which it is extended forwardly of said housing portion so that a binder-inserting hole of the binder-charged portion is closed when the housing portion is in said first condition.

In the third invention, said binder-charged portion is provided with cleaning means for cleaning said surfaces of said heat source or said electrodes which engage with said binder, and means for operating said cleaning means during the bookbinding operation.

In the fourth invention, said surfaces where said heat source or said electrodes are engaged with said binder are adapted to be moved between a bookbinding position in which they face said binder-inserting hole of said binder-charged portion and a masking (or retracted) position in which they are masked from the binder-inserting hole (i.e. retracted from the binder-charged portion). Also, a means is provided for moving the heat source or the electrodes which engage with the binder to said bookbinding position during the bookbinding operation.

And, in said fifth and sixth inventions, the respective image-forming apparatus are provided with a binder-charged portion provided with an electric heating member, with an adhesive applied thereto, formed on the inner surface of a back cover thereof. Said binder-charged portion is provided with an electrode for electrifying said electric heating member on a bottom portion thereof to adhere a plurality of papers disposed in a binder to an inner surface of said back cover of said binder by heating and melting said adhesive by means of the electric heating member. In addition, in the fifth invention the binder-charged portion is provided with a foreign matter-removal hole formed in a bottom portion thereof. A cover member for covering said electrode is provided and is movable between a first posture in which it extends across a binder insertion path and is inclined toward said foreign matter-removal hole and a second posture in which it is retracted from said binder-insertion path. An upper portion of the cover member acts as a swinging center therefor, and a means is provided for moving said cover member to said second posture during the bookbinding operation.

On the other hand, in the sixth invention, a means is provided for adjusting the amount of electric power applied between said electrodes, or for adjusting the period of time for applying a constant electric current, to maintain a total calorific value per unit length of the electric heating member almost constant.

According to the first to sixth inventions, the installation space can be reduced in comparison with that in the case where the image-forming apparatus and the bookbinding device are separately provided by adding the function of the bookbinding device to the image-forming apparatus such that constituent members of the two devices can be commonly used. This also results in an economic advantage.

Additionally, in the first invention, since the binder-inserting hole is provided with a cover, foreign matter can be prevented from entering the binder-charged portion when no bookbinding operation is in progress. Thus, poor contact of the back cover and the binder with the heat source and poor contact of the electric current-receiving terminal with the electrode, cab be prevented.

In the second invention, since, upon moving the binder-charged portion to the first condition when no bookbinding operation is in progress, the binder-inserting hole of the binder-charged portion is closed by part of the housing portion, foreign matter is prevented from entering the binder-charged portion when no bookbinding operation is in progress, in the same manner as in the first invention.

In the third invention, even if foreign matter enters the binder-charged portion through the binder-inserting hole and becomes stuck to the heat source or the electrode, the cleaning means is operated to clean the surface where the heat source or the electrode is engaged with the binder during the bookbinding operation, so that poor contact of the back cover of the binder with the heat source and poor contact of the electric current-receiving terminal with the electrode is prevented.

In the fourth invention, since the binder-charged portion is changed over to the masking (or retracted) position when no bookbinding operation is in progress, foreign matter will not likely become stuck to the surface of the heat source or the electrode which engages with the binder. Thus, poor contact of the heat source or the electrode with the binder can be prevented even if foreign matter has entered the binder-charged portion.

In the fifth invention, since the cover member is moved to the first posture in which it covers the feeding electrode when no bookbinding operation is in progress, foreign matter, which has entered the binder-charged portion, is guided by means of the cover member to be discharged out of the binder-charged portion through the foreign matter-removal hole.

In the sixth invention, since the total calorific value per unit length of the electric heating member is maintained almost constant for different binder sizes, excessive heating and insufficient heating of the electric heating member can be prevented.

DESCRIPTION OF THE PREFERRED EMBODIMENTS

The preferred embodiments of the present invention will be described below with reference to the drawings.

First Preferred Embodiment of the First Invention

Figure 1:
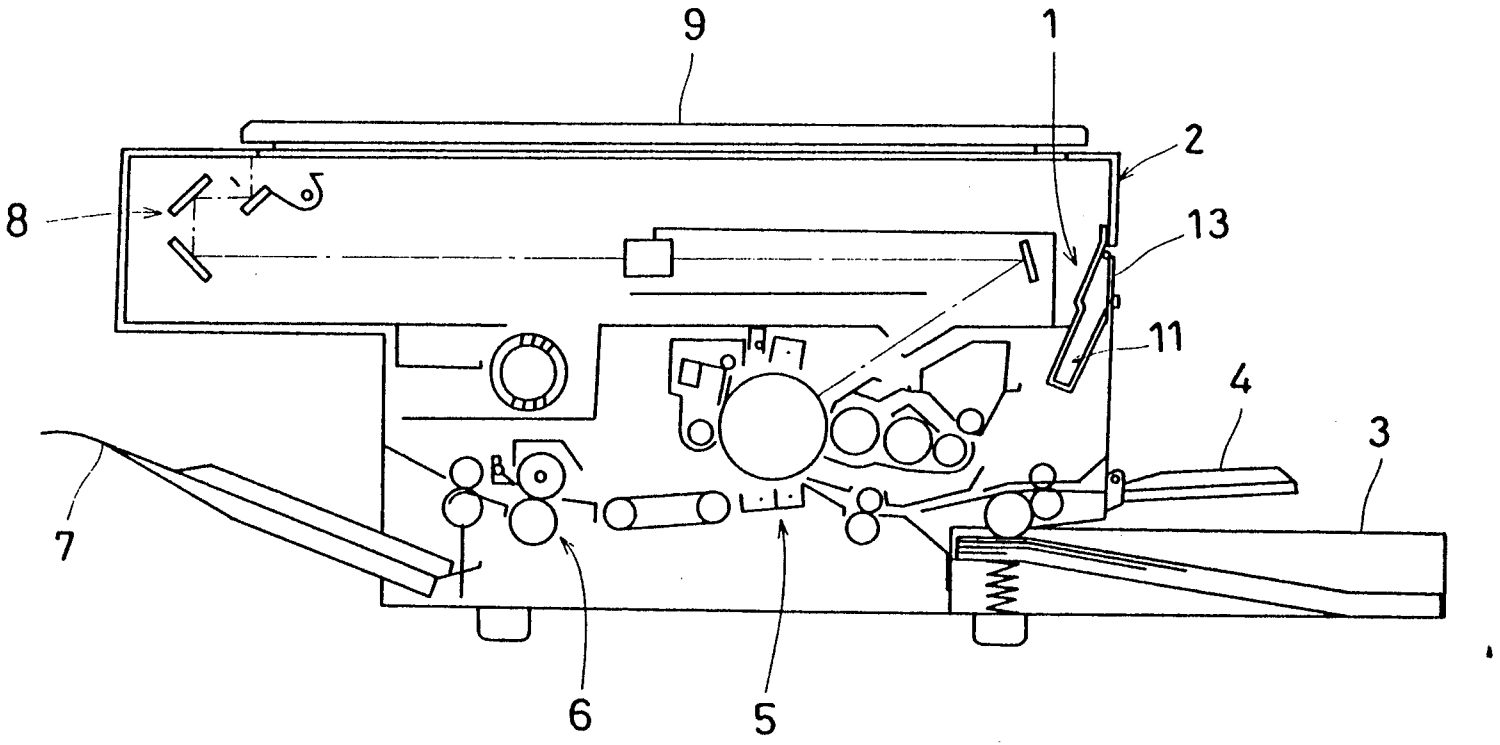
FIG. 1 is a schematic longitudinal side view showing an electrostatic photographic copying machine as one example of an image-forming apparatus.
Figure 2:
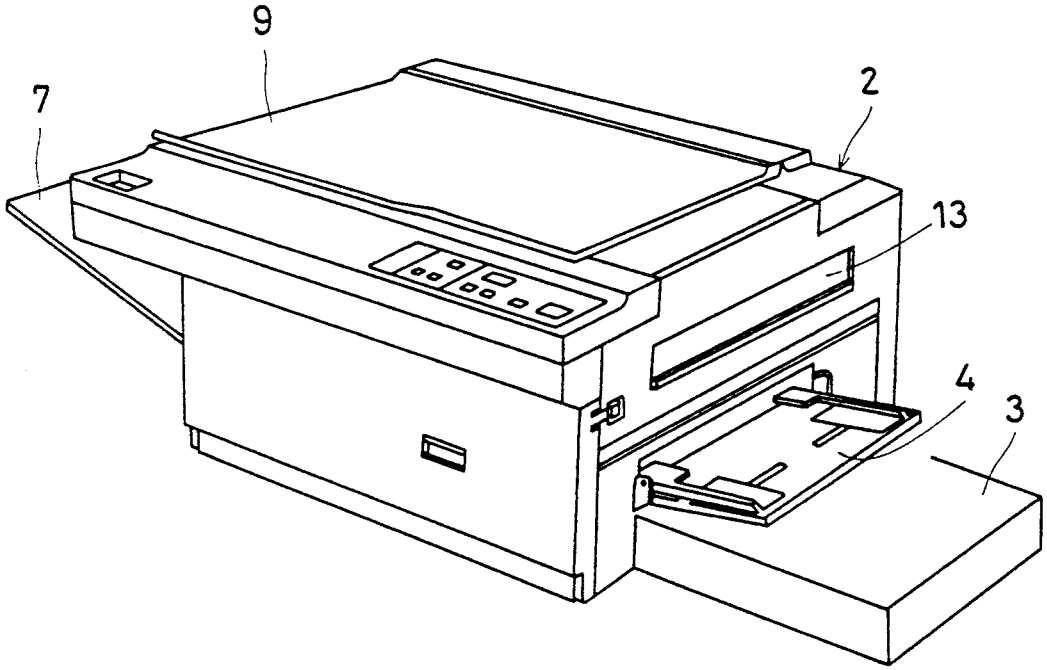
FIG. 2 is a perspective view showing the whole copying machine shown in FIG. 1.

FIGS. 1 and 2 show an electrostatic photographic copying machine provided with a bookbinding device 1 according to a first invention as one example of an image-forming apparatus.

Referring now to FIGS. 1 and 2, reference numeral 2 designates a housing, reference numeral 3 designates a paper-supplying cassette, reference numeral 4 designates a manual paper-supplying table, reference numeral 5 designates an image-making portion having a known construction, reference numeral 6 designates fixing portion, reference numeral 7 designates a paper-discharging tray, reference numeral 8 designates an optical system, and reference numeral 9 designates a manuscript-weight.

Figure 3A:
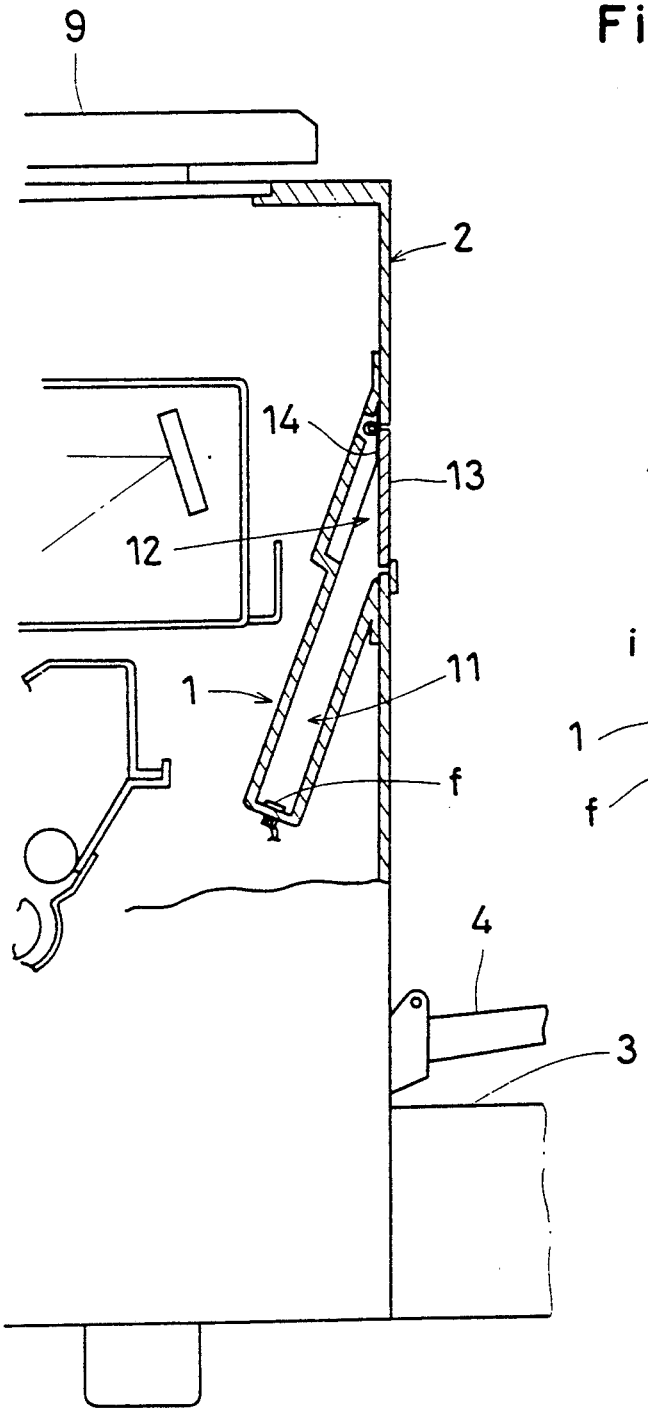
FIGS. 3(A) and (B) are sectional views showing main parts of a bookbinding device according to a first preferred embodiment of a first invention.
Figure 29:
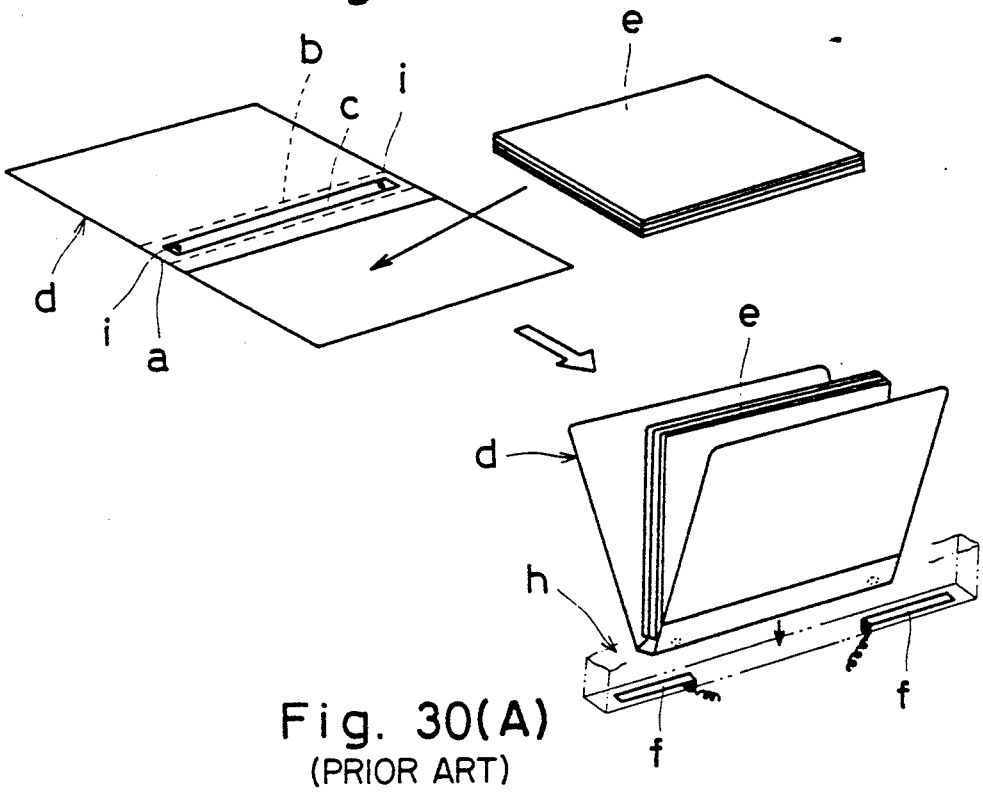
Fig. 29 (PRIOR ART)
FIG. 29 and FIGS. 30(A) and (B) are diagrams showing a conventional bookbinding device.
Figure 30A:
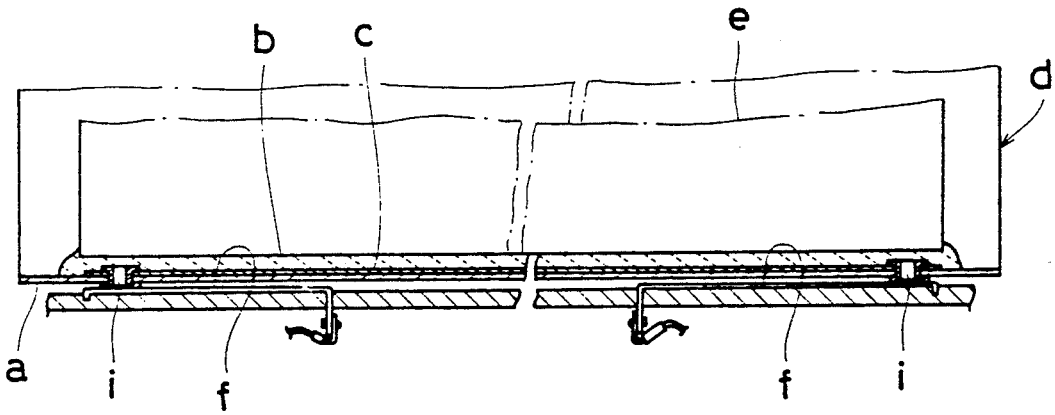
Fig. 30(A) (PRIOR ART)
Figure 30B:
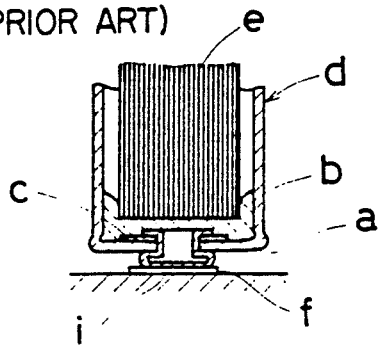
Fig. 30(B) (PRIOR ART)

In said bookbinding device 1, shown also in FIGS. 3(A) and (B), said housing 2 in an upper portion of said manual paper-supplying table 4 is provided with an opening 10 and a binder charging (or receiving) portion 11 provided with an electric heating member (c) with an adhesive (b) on the inner surface of a back cover (a) (refer to FIG. 29 and FIGS. 30(A) and (B) for a detailed showing of the binder (d)) therewithin so that a binder-inserting hole 12 of said charging portion 11 may face said opening 10 and said binder-inserting hole 12 is provided with a closing cover 13.

Said binder charged (or binder receiving) portion 11 is provided with a pair of feeding electrodes (f), (f) for a pair of electric current-receiving terminals (i), (i) of said electric heating member (c) therewithin. With such arrangement, a plurality of papers (e) may be adhered to said inner surface of said back cover (a) of said binder (d) by inserting the binder (d) in the binder-charged portion 11, the binder (d) having said plurality of papers (e) inserted therein, and applying an electric current to the electric heating member (c) from said feeding electrodes (f), (f) to heat and melt said adhesive (b) by the heating of the electric heating member (c).

Said cover 13 is pivotable about a hinge between an upper end edge thereof and an upper portion of the binder-charged portion 11 so as to be swingable from a covering position in which it is substantially coplanar with a side surface of the housing 2 to an opened position in which it is swung inwardly into the binder-charged portion 11 against the bias of a biasing means 14, such as a spring, so as to be normally maintained in the covering position.

According to the above described preferred embodiment, a shown in FIG. 3(A), the cover 13 of the binder-inserting hole 12 is closed when no bookbinding operation is taking place, such that foreign matters, such as paper dust, can be prevented from entering the binder-charged portion 11.

Figure 3B:
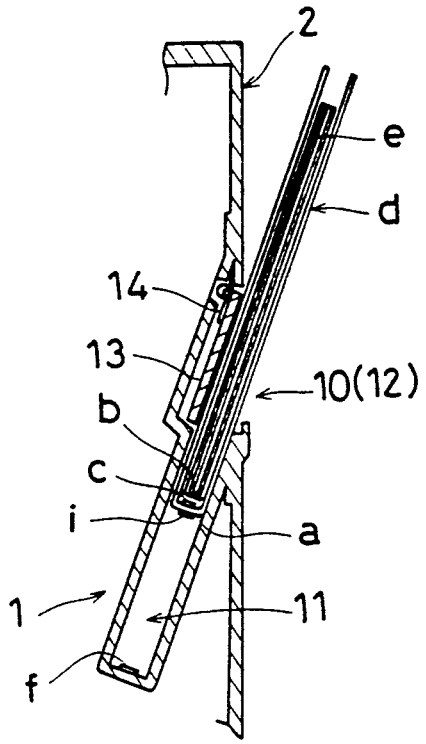

During said bookbinding operation, as shown in FIG. 3(B), upon charging the binder-charged portion 11 with the binder (d) (i.e. upon inserting the binder (d) into the binder receiving portion 11), the cover 13 is opened by a pressing force of the binder (d), and, when the binder (d) is inserted such that said electric current-receiving terminals (i), (i) of the binder (d) are brought into contact with the feeding electrodes (f), (f) of the binder-charged portion 11, an electric current is applied to the electric heating member (c) through the feeding electrodes (f), (f).

Because the binder-inserting hole 12 was maintained closed by the cover 13 prior to the binder (d) being inserted into the binder-charged portion 11 so as to prevent said foreign matter from being stuck to surfaces where the feeding electrodes (f), (f) are engaged with the binder (d), the adhesive (b) can be sufficiently heated and melted to adhere the papers (e) to the inner surface of the back cover of the binder (d) to perform the bookbinding operation by bringing the electric current-receiving terminals (i), (i) of the electric heating member (c) into good contact with the feeding electrodes (f), (f) to heat the electric heating member (c).

And, upon taking the bound binder (d) out of the binder-charged portion 11, the cover 13 automatically closes the binder-inserting hole 12 due to the biasing means 14.

Second Preferred Embodiment of the First Invention

Figure 4A:
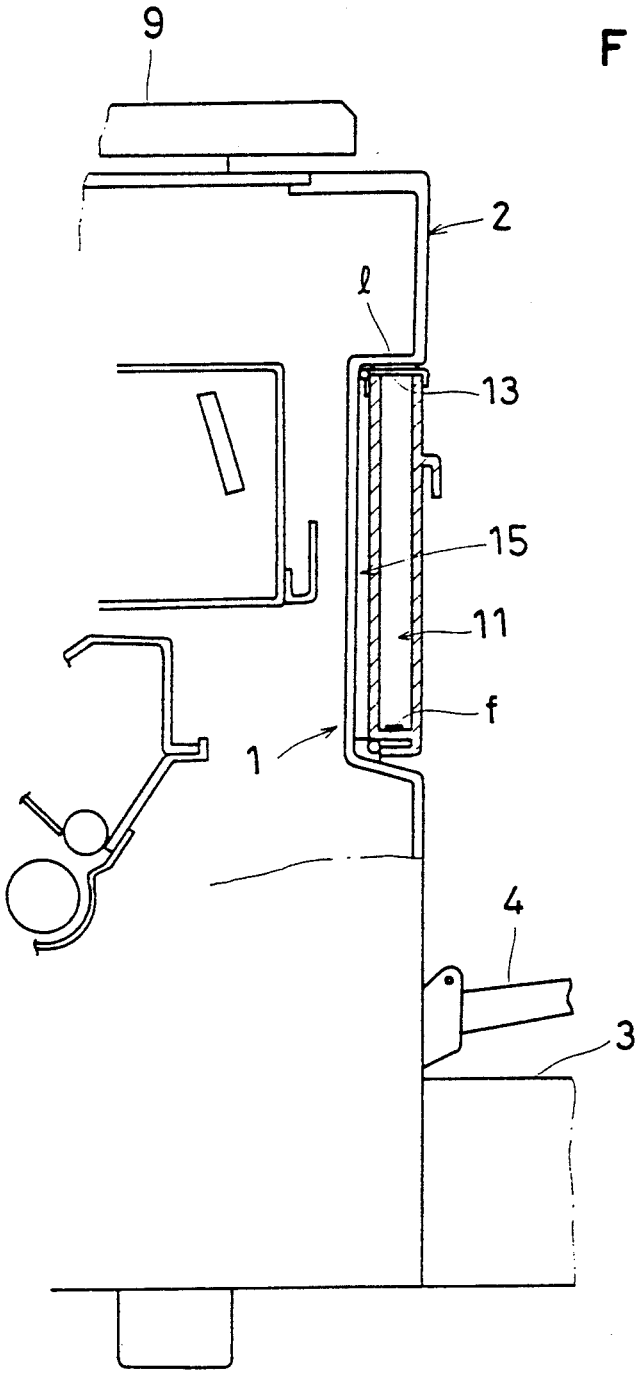
FIGS. 4(A) and (B) are sectional views showing main parts of a bookbinding device according to a second preferred embodiment of the first invention.
Figure 4B:
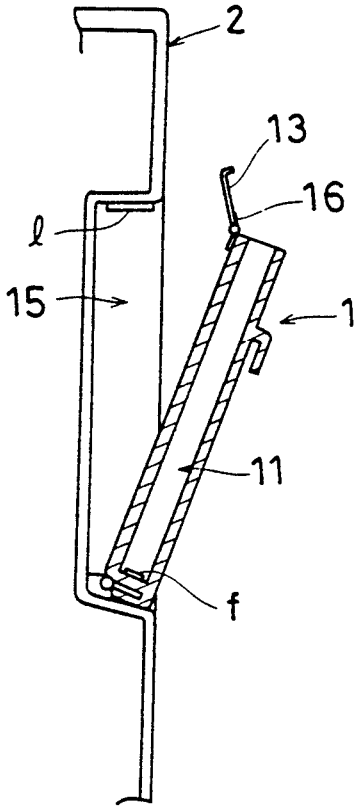

FIGS. 4(A) and (B) show a second preferred embodiment of the first invention. This preferred embodiment is characterized in that a housing 2 is provided with a binder-charged portion housing portion 15 formed as a concave (or recessed) portion in a side surface thereof. The binder-charged portion-housing portion 15 is provided with a binder-charged portion 11 pivotably mounted at a lower portion thereof, such that the binder-charged portion 11 can be pivoted between a first (closed) condition in which it is housed in the binder-charged portion-housing portion 15 and a second (open) condition in which it projects outwardly of the housing portion 15 with a binder-inserting hole 12 projecting out of the housing portion 15.

And, a cover 13 is provided for said binder-inserting hole 12 and is biased to an opened posture by means of biasing means 16 so that the binder-inserting hole 12 may be automatically opened when the binder-charged portion 11 is pivoted into said second condition, and so that, upon pivoting of the binder-charged portion 11 to said first condition, said cover 13 engages with a corner portion of said housing 2 at an upper wall of the housing portion 15, and is thereby closed. An elastic plate member is provided at said upper wall to press against the cover 13 to maintain the binder-charged portion 11 in the first condition. Otherwise, the construction is the same as in the preceding first preferred embodiment, with the like members being designated by like reference numerals and their description being omitted.

Third Preferred Embodiment of the First Invention

Figures 5A, 5B, 5C:
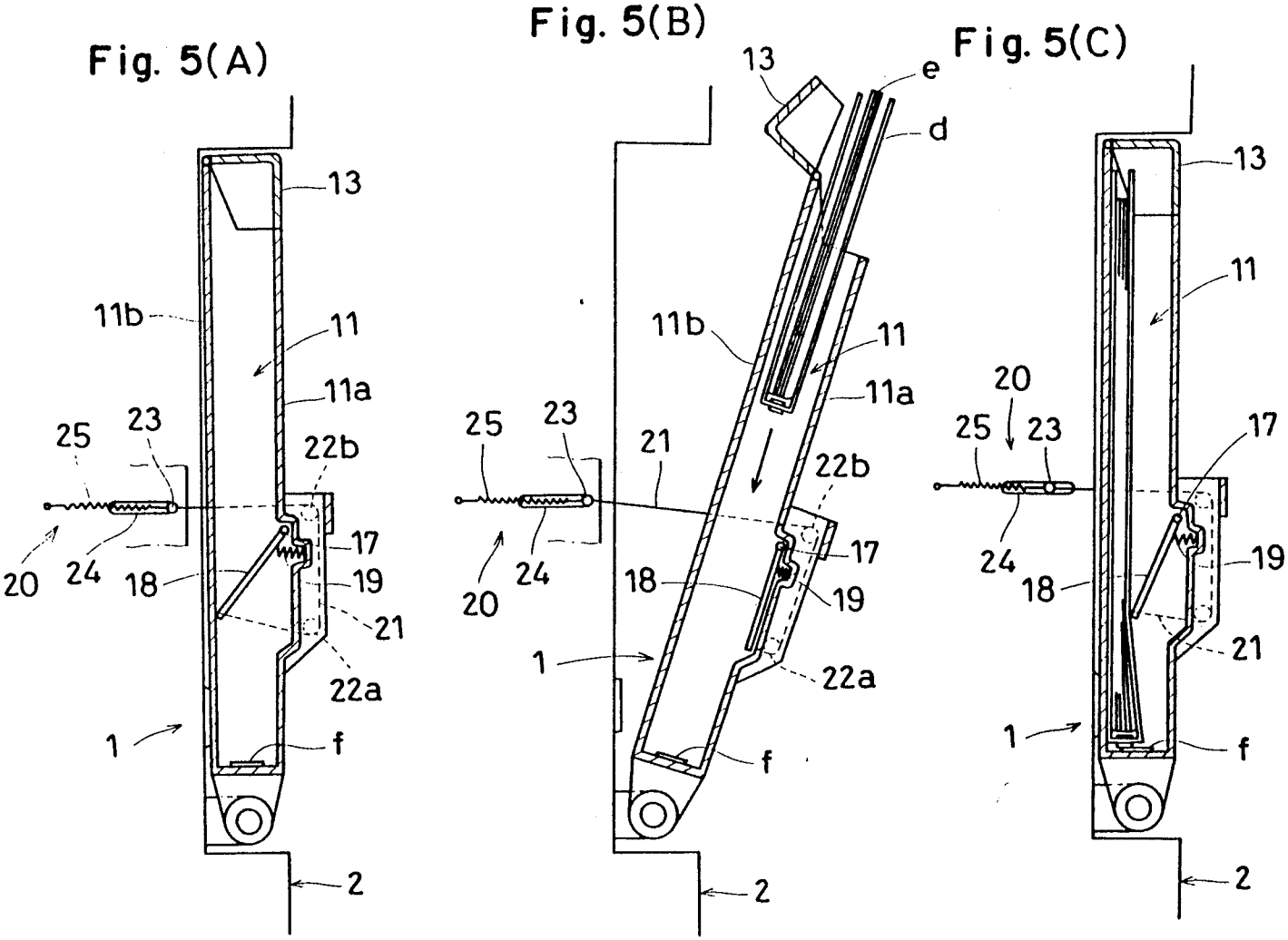
FIGS. 5(A), (B) and (C) are sectional views showing main parts of a bookbinding device according to a third preferred embodiment of the first invention.

FIGS. 5(A), (B) and (C) show a third preferred embodiment. This preferred embodiment is characterized in that the construction is like that of the second preferred embodiment shown in FIGS. 4(A) and (B), except that a pressing means 18 is provided. The pressing means 18 is pivoted so as to be swingable in the direction of the thickness of the binder (d) around a shaft 17. A spring 19 is provided for biasing the pressing means 18 toward a rear wall portion (b) and a displacing means 20 is provided for use in swinging the pressing means 18 against the bias of the spring 19 as the binder-charged portion 11 is pivoted from its first condition to its second condition. As shown in FIGS. 5(B) and 5(C), due to the bias force of the spring 19, upon pivoting of the binder-charged portion 11 to the first condition, the pressing means 18 is returned to its normal posture.

According to this third preferred embodiment, as shown in FIG. 5(B), since the pressing means 18 is swingably displaced toward the front wall portion 11*a* (changed over to the non-pressed condition) by pivoting of the binder-charged portion 11 to the second condition, no trouble may occur during inserting of the binder (d) into the binder-charged portion 11. Also, due to the bias force of the spring 19, upon insertion of the binder (d) in the binder-charged portion 11 and pivoting of the binder-charged portion 11 to the first condition, the pressing means 18 presses the binder (d) toward the rear wall portion 11*b*.

In addition, due to the pressing of the binder (d) against the rear wall 11*b*, sideways displacement of the papers disposed in the binder (d) is prevented during the bookbinding process.

A wire 21 of said displacing means 20 is connected near a free end of the pressing means 18 at one side thereof, said wire 21 being trained about two pulley 22*a*, 22*b* provided externally of the binder-charged portion 11, and the wire 21 being connected with a support member 23 provided on the side of the wall of housing 2 opposite the binder-charged portion 11. With this arrangement, upon pivoting of the binder-charged portion 11 to the second condition, the wire 21 is pulled to swing the pressing means 18 against the spring 19.

The support member 23 is adapted to be movable along a long hole 24 formed in the housing 2, and a spring 25 is provided between the support member 23 and the housing 2 for absorbing a looseness of the wire 21.

In addition, in order to easily insert the binder (d) in the binder-charged portion 11 and discharge the binder (d) from the binder-charged portion 11, it is desirable that, the upper end of the front wall portion 11*a* of the binder-charged portion 11 have a cut-off shape as shown in FIG. 5(B), with the cover 13 having a shape complementary to the cut-off shape. Since this embodiment is otherwise constructed in the same manner as the first preferred embodiment, like members are designated by like reference numerals and their description is omitted.

Fourth Preferred Embodiment of the First Invention

Figure 6:
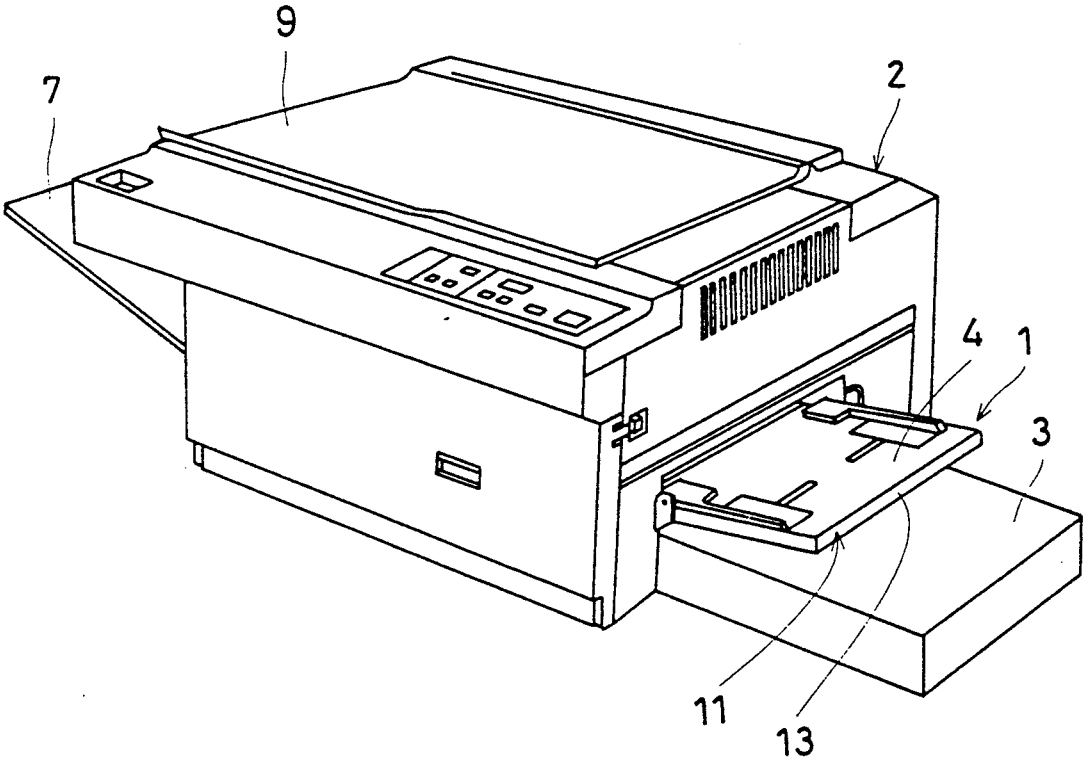
FIG. 6 is a perspective view showing the whole copying machine provided with a bookbinding device according to a fourth preferred embodiment of the first invention.
Figure 7:
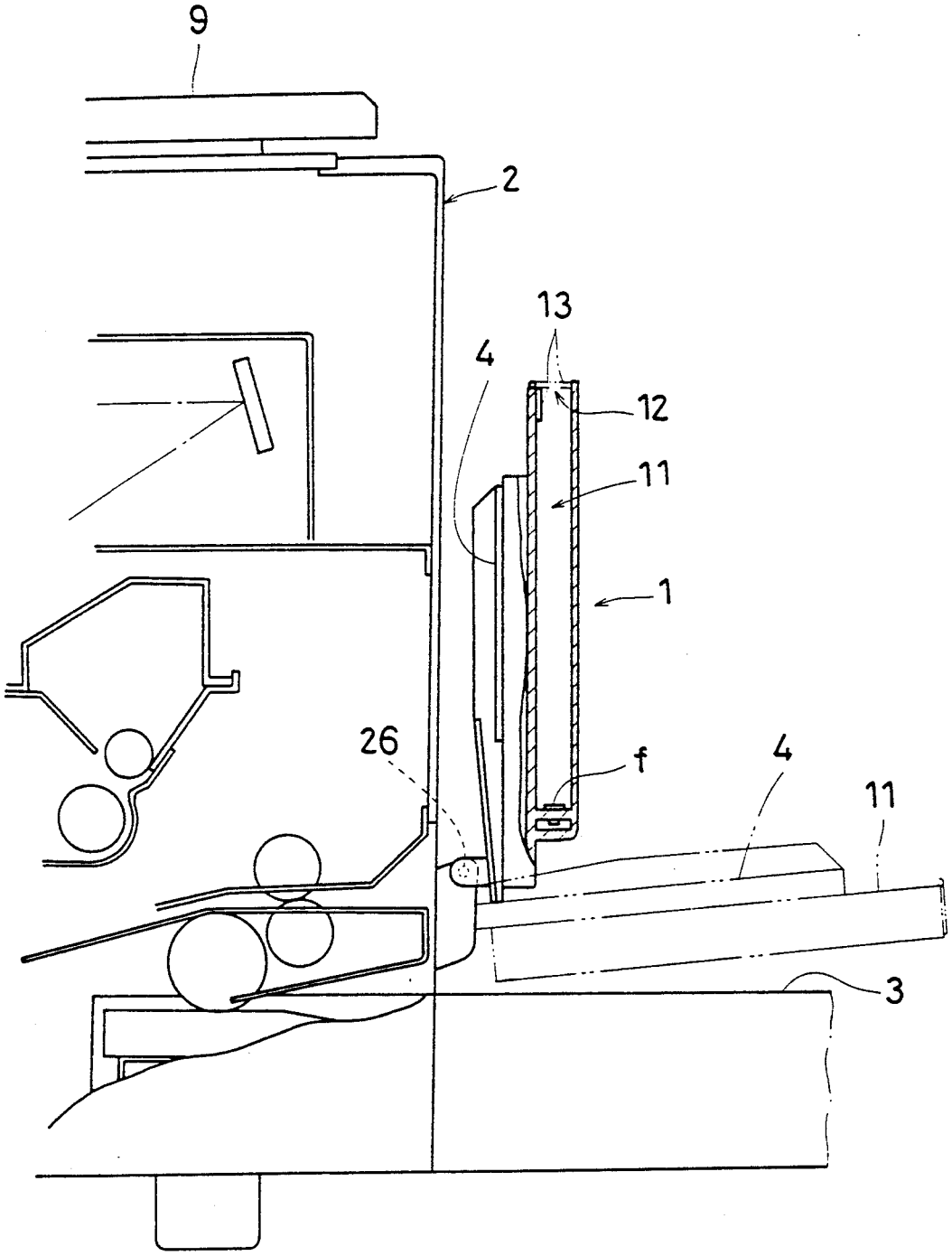
FIG. 7 is a sectional view showing main parts of the copying machine shown in FIG. 6.

FIG. 6 shows an electrostatic copying machine as one example of an image-forming apparatus provided with a bookbinding device 1 according to a fourth preferred embodiment of the first invention, and FIG. 7 shows details of the electrostatic photographic copying machine shown in FIG. 6. The fourth preferred embodiment of the first invention is characterized in that a binder-charged portion 11 is provided on a lower side of a manual paper-supplying table 4, and said manual paper-supplying table 4 provided with said binder-charged portion 11 is adapted to be swingable around a shaft 26 mounted to the housing 2. Thus, the manual paper-supplying table 4 can be pivoted between a substantially horizontal paper-supplying posture (i.e. paper supply position) suitable for providing the manual paper-supply (as shown by a phantom line in FIG. 7) and a vertical posture (i.e. bookbinding position) in which a binder-inserting hole 12 is directed upwardly for use in inserting the binder (d) into the binder-charged portion 11 during the bookbinding operation (as shown by a solid line in FIG. 7).

A cover 13 for said binder-inserting hole 12 is adapted to close the binder-inserting hole 12 by its own weight when the manual paper-supplying table 4 is pivoted to said paper-supplying posture, and is adapted to open the binder-inserting hole 12 by its own weight when the manual paper-supplying table 4 is pivoted to said bookbinding position.

Since the construction of this embodiment is otherwise the same as the first preferred embodiment, like members are designated with like reference numerals as in the first preferred embodiment and their description is omitted.

Fifth Preferred Embodiment of the First Invention

Figure 8:
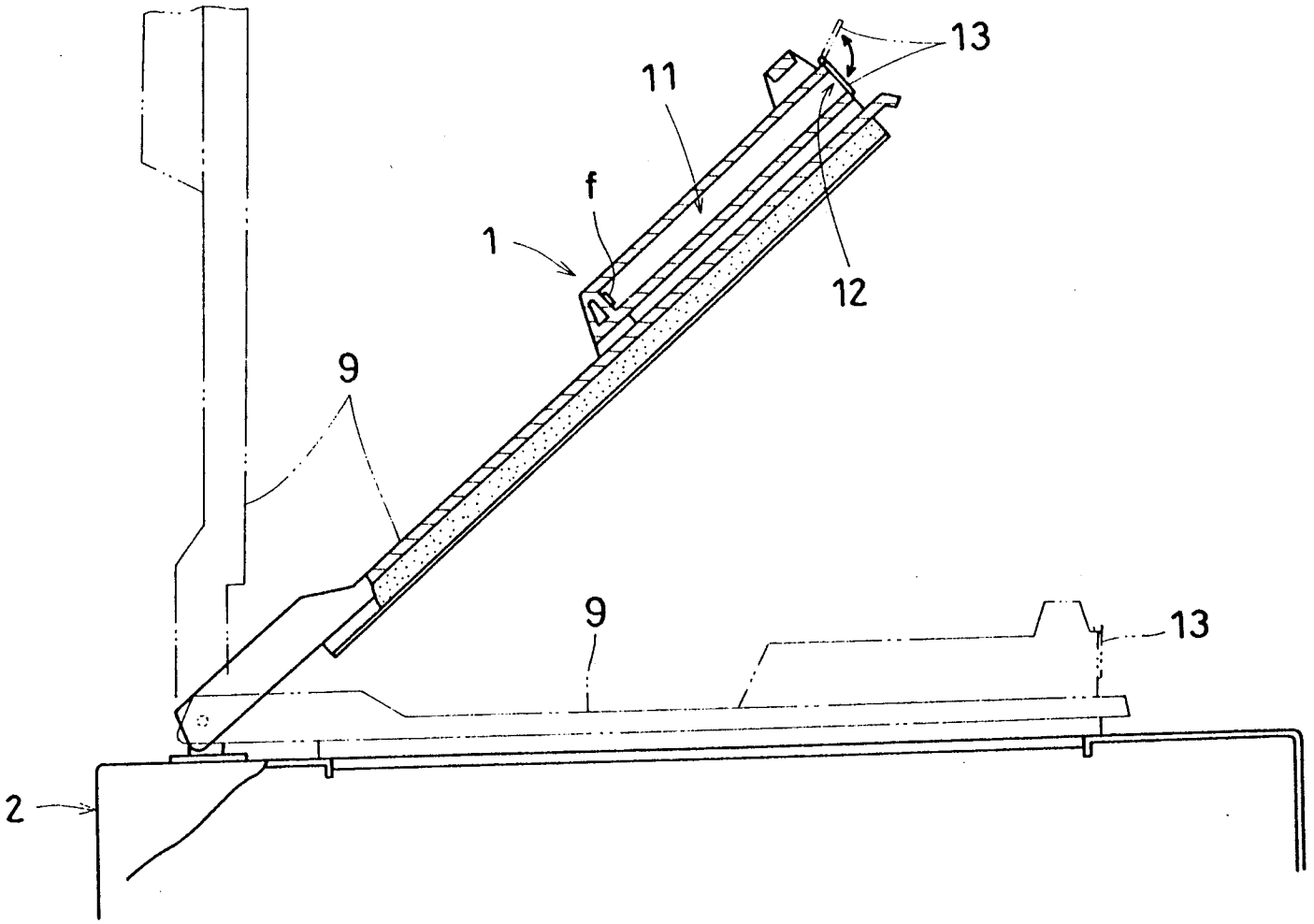
FIG. 8 is a sectional view showing main parts of a bookbinding device according to a fifth preferred embodiment of the first invention.

FIG. 8 shows a fifth preferred embodiment of the first invention. This preferred embodiment is characterized in that a manuscript-weight 9 is provided with a binder-charged portion 11. In addition, although a cover 13 may be adapted to swing inward of said binder-charged portion 11 to open it, said cover 13 is adapted to be closed by its own weight or biased closed by a spring, to thereby cause swinging of the cover 13 out of the binder-charged portion 11 and thus opening of the cover 13 in the preferred embodiment shown. This is done because it is unnecessary to open the binder-inserting hole 12 of the binder-charged portion 11 every time the manuscript-weight goes up and down.

Since the construction of this embodiment is otherwise the same as in the first preferred embodiment, like members are designated by like reference numerals as in the first preferred embodiment and their description is omitted.

Preferred Embodiment of the Second Invention

Figure 9A:
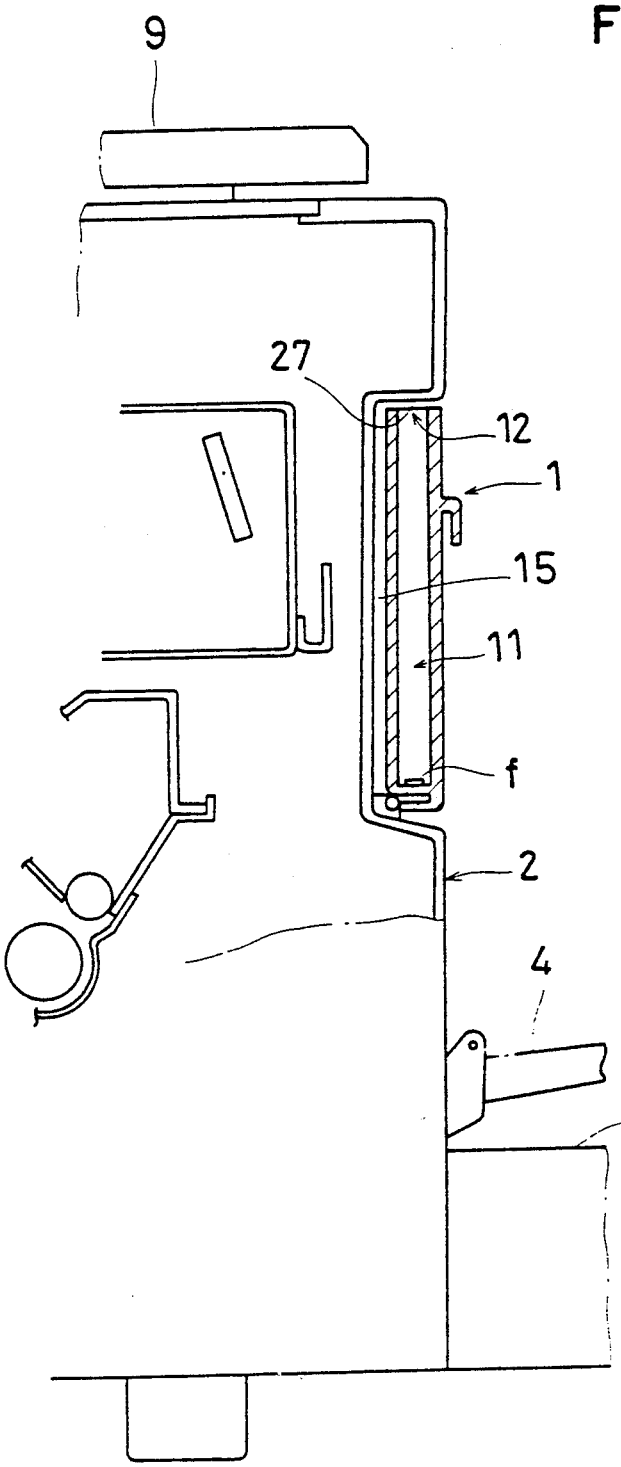
FIGS. 9(A) and (B) are sectional views showing main parts of a bookbinding device according to a second invention.
Figure 9B:
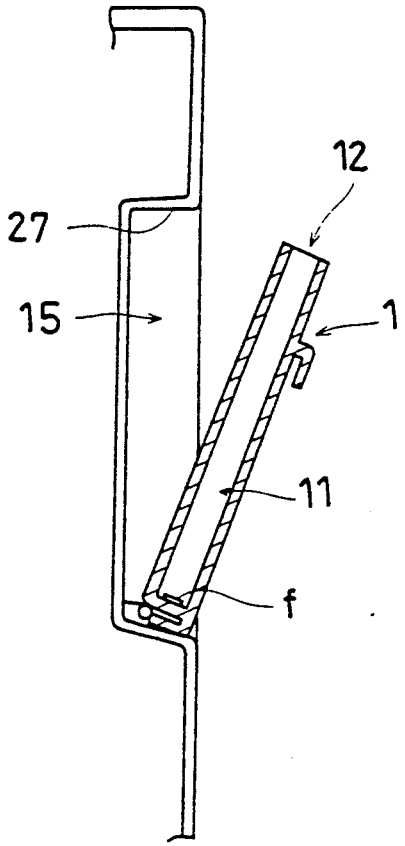

FIGS. 9(A) and (B) show a bookbinding device 1 corresponding to the second invention. In the second invention, no cover 13, such as in the second preferred embodiment of the first invention shown in FIGS. 4(A) and (B), is provided. In this second invention, a housing 2 is provided with a binder-charged portion-housing portion 15 formed in the form of a concave (or recessed) portion on a side surface thereof and said binder-charged portion-housing portion 15 is provided with a binder-charged portion 11 pivotally mounted at a lower end thereof. Thus, said binder-charged portion 11 can be pivoted between a first condition in which it is housed in the binder-charged portion-housing portion 15 and a second condition in which it extends outwardly of the housing portion 15 such that a binder-inserting hole 12 projects out of the housing portion 15. Said binder-inserting hole 12 is closed by an upper wall 27 of the housing portion 15 when the binder-charged portion 11 is pivoted to said first condition.

That is, the second invention is characterized in that the binder-charged portion-housing portion 15 is formed by said housing 2 with said upper wall 27 of the housing portion 15 being also used as a cover for the binder-inserting hole 12. Thus, a bookbinding operation mode can be immediately selected by projecting the binder-charged portion 11 out of the housing portion 15, and foreign matter can be prevented from entering the binder-charged portion 11 by merely pushing the binder-charged portion 11 into the housing portion 15 without requiring a special operation of closing said cover.

Since the construction of the second invention is otherwise the same as in the first preferred embodiment of the first invention, like members are designated by like reference numerals as in the first preferred embodiment of the first invention and their description is omitted.

In addition, the housing portion 15 can be provided with an elastic plate member such as shown in FIGS. 4(A) and (B), on the upper wall 27 thereof so that said elastic plate member can enter the binder-inserting hole 12 under a slightly deformed condition when the binder-charged portion 11 is pivoted to the first condition, in order to properly close the binder-inserting hole 12.

In addition, a binder-pressurizing construction, such as shown in FIGS. 5(A) to (C), can be incorporated.

First Preferred Embodiment of the Third Invention

Figure 10:
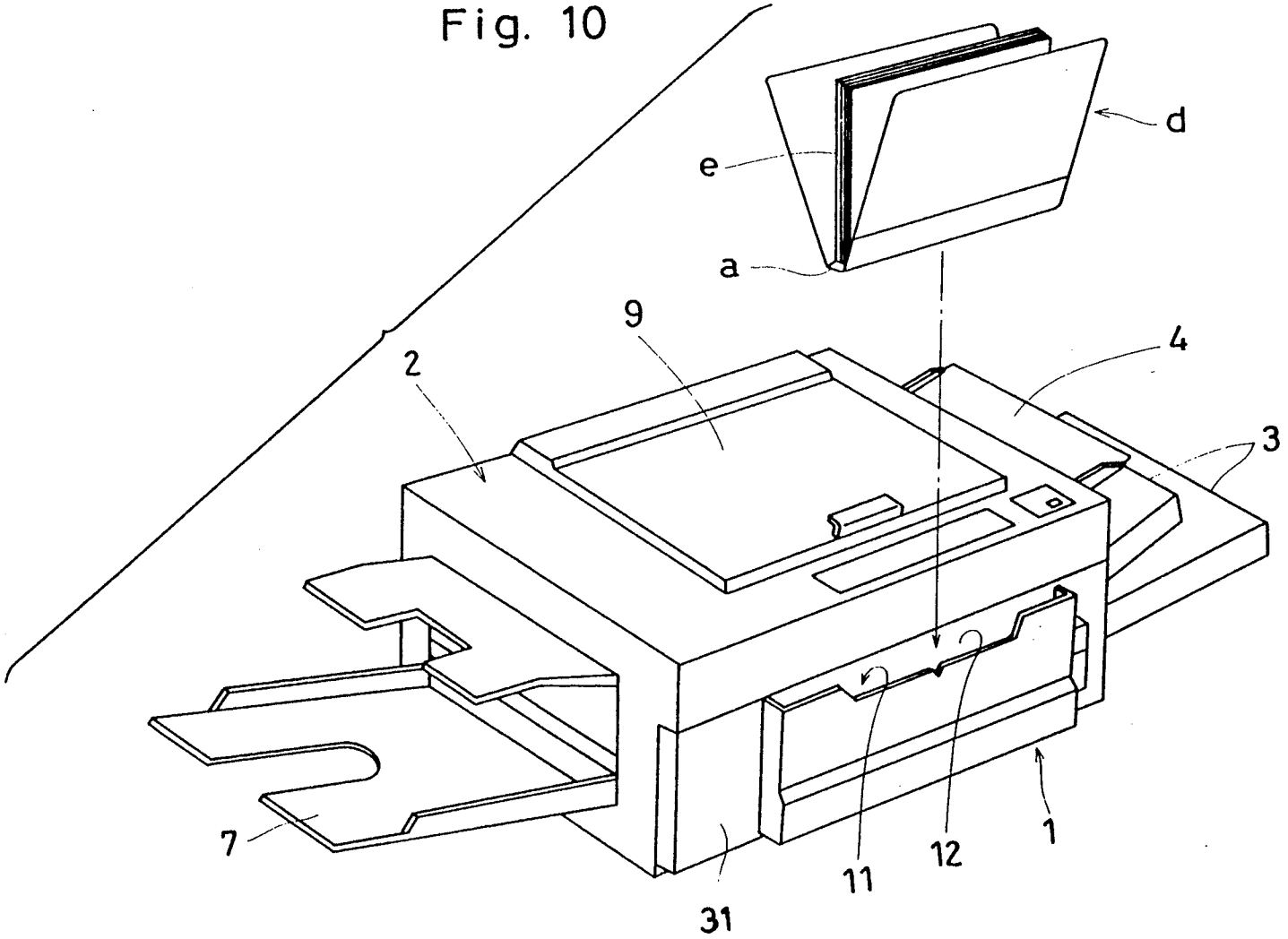
FIG. 10 is a perspective view showing the whole copying machine provided with the bookbinding device according to a first preferred embodiment of a third invention.
Figure 11:
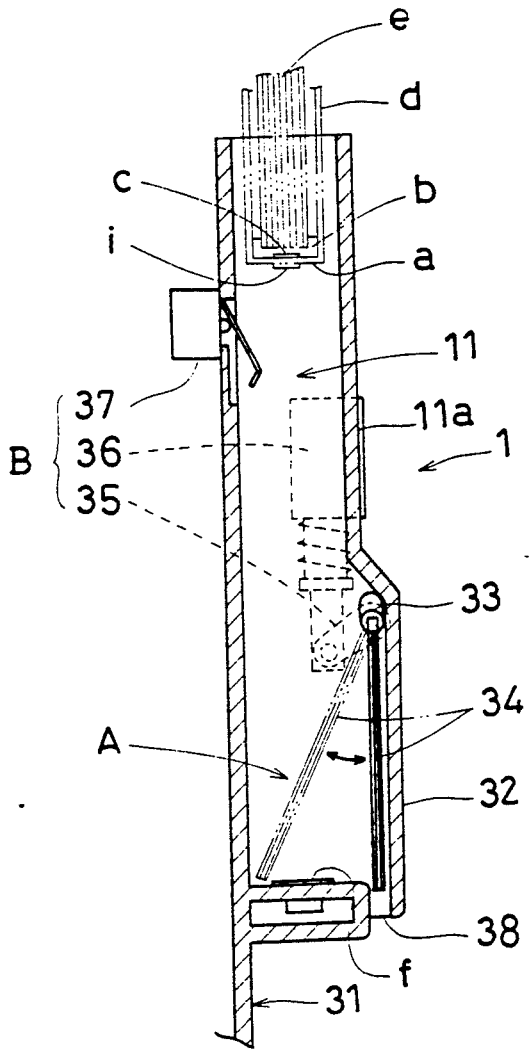
FIG. 11 is a sectional view showing main parts of the copying machine shown in FIG. 10.

FIG. 10 shows an electrostatic photographic copying machine as one example of an image-forming apparatus provided with a bookbinding device 1 according to a first preferred embodiment of the third invention, and FIG. 11 shows details of the electrostatic photographic copying machine shown in FIG. 10. In this preferred embodiment, the electrostatic photographic copying machine is provided with a binder-charged portion 11 which is provided with feeding electrodes (f), (f) on an inner bottom portion thereof. The binder-charged portion 11 is mounted on, and is partially defined by, an outer surface of a front cover 31 of a housing 2. The binder-charged portion 11 is provided with a binder-inserting hole 12 directed upwardly, a cleaning means A for cleaning said feeding electrodes (f), (f) and an operation means B for operating said cleaning means A.

The cleaning means A is adapted to be automatically operated upon insertion of a binder (d) into said binder-charged portion 11 during the bookbinding operation.

More specifically, an example of the cleaning means A comprises an outwardly expanded portion 32 of a front wall 11*a* of the binder-charged portion 11, a shaft 33 mounted above the feeding electrodes (f), (f) in an upper portion of said expanded portion 32 so as to not hinder insertion of said binder (d), and brushes 34 mounted to both sides of said shaft 33. The brushes 34 are adapted to be moved between a bookbinding position (shown by a phantom line in FIG. 11) to a retracted position retracted from the binder-charged portion 11 (as shown by solid line in FIG. 11).

On the other hand, said operating means B comprises a link 35 mounted to one end of the shaft 33 projected out of the binder-charged portion 11, a solenoid 36 for operating the brushes 34 to move between said bookbinding position and said retracted position by regularly and oppositely driving the shaft 33 through said link 35, and a micro switch (sensor) 37 for detecting the insertion of the binder (d) into the binder-charged portion 11 and actuating said solenoid 36. Reference numeral 38 designates a foreign matter-removal hole provided through a bottom surface of the binder-charged portion 11.

According to the above described preferred embodiment, the brushes 34 exist at the bookbinding position shown by the phantom line in FIG. 11 during the time when the binder (d) is not inserted in the binder-charged portion 11.

Upon inserting the binder (d) into the binder-charged portion 11, the insertion of the binder (d) is detected by said sensor 37 to drive the solenoid 36 and thereby rotate the shaft 33 so as to swing the brushes 34 to the retracted position, as shown by the solid line in FIG. 11.

That is, the means B for operating the cleaning means A is operated by detecting the insertion of the binder (d) into the binder-charged portion 11 during the bookbinding operation.

Thus, even if foreign matter, such as paper dust, becomes stuck to surfaces of said feeding electrodes (f), (f) which engage with the binder, it is brushed off by means of the brush 34 to clean said surfaces of the feeding electrodes (f), (f). The brushed-off foreign matter is discharged out of the binder-charged portion 11 through said foreign matter-removal hole 38.

Accordingly, the electric current-receiving terminals (i), (i) of the electric heating member (c) are brought into good contact with the feeding electrodes (f), (f) to cause heating of the electric heating member (c) in the appointed manner, whereby the adhesives (b) can be sufficiently heated and melted to adhere the papers (e) to the inner surface of the back cover of the binder (d). Thus, the book is bound.

Second Preferred Embodiment of the Third Invention

Figure 12:
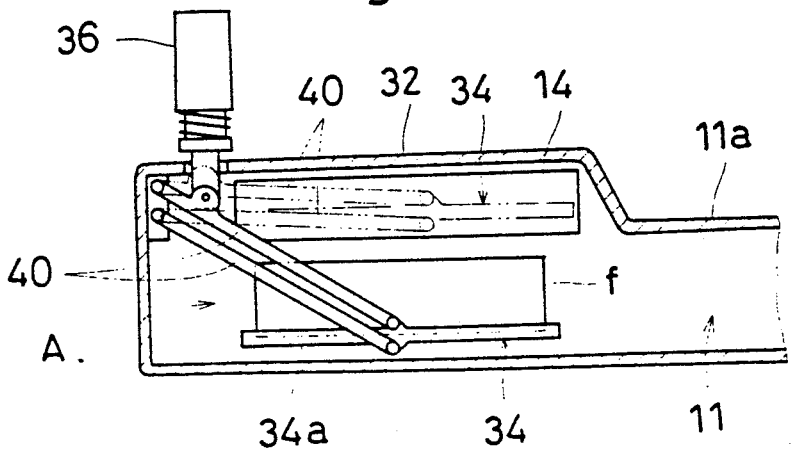
FIG. 12 is a sectional view showing main parts of a bookbinding device according to a second preferred embodiment of a third invention.

FIG. 12 shows the cleaning device A according to a second preferred embodiment of the third invention. This preferred embodiment is characterized in that a brush 34, comprising a cylindrical substrate 34*a* and a group of hairs (not shown) mounted on a lower surface of said cylindrical substrate 34*a*, is provided as said cleaning means A within a binder-charged portion 11. Said brush 34 is reciprocally moved in a horizontal manner by means of a solenoid 36 through a parallel four-jointed link 40. Since the construction of this embodiment is otherwise the same as in the preceding first preferred embodiment of the third invention, like members are designated by like reference numerals as in the first preferred embodiment and their description is omitted.

Third Preferred Embodiment of the Third Invention

Figure 13:
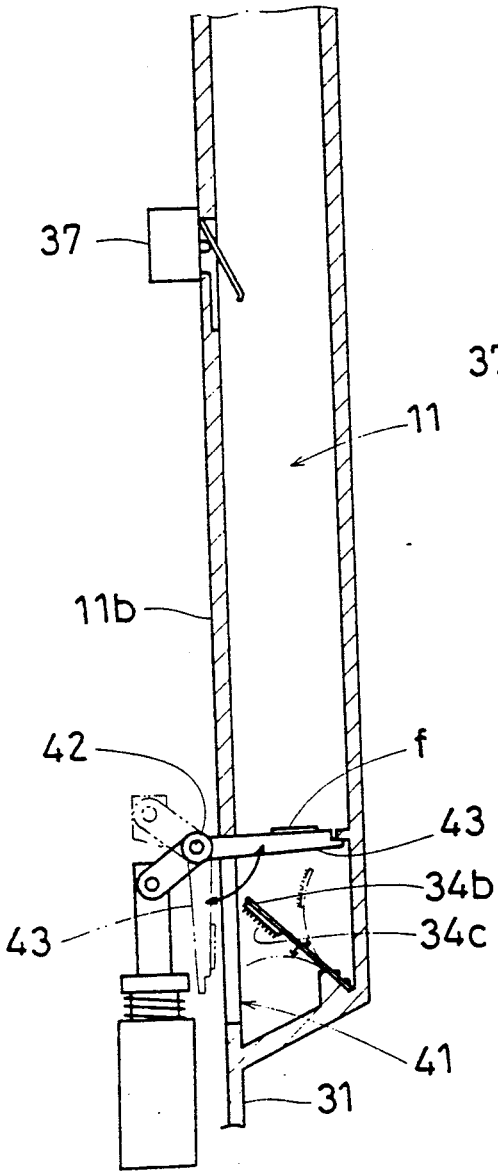
FIG. 13 is a sectional view showing main parts of a bookbinding device according to a third preferred embodiment of the third invention.

FIG. 13 shows the cleaning device A and the operating device B according to a third preferred embodiment of the third invention. This preferred embodiment is characterized in that a binder-charged portion 11 is provided with an opening 41 formed in a lower end of a rear wall portion 11*b*. An electrode-receiving member 43 is provided so as to be swingable around a shaft 42, and said electrode-receiving member 43 is provided with feeding electrodes (f), (f) arranged on an upper surface thereof. With this arrangement, said feeding electrodes (f), (f) can be moved between a bookbinding position (shown by a solid line) in which the member 43 extends through the hole 41 into the binder-charged portion 11 and a retracted position retracted from said binder-charged portion 11 (shown by a phantom line). The binder-charged portion 11 is provided with a brush 34 comprising a plate spring 34*b* and a brush material 34*c* mounted on a lower surface of said plate spring 34*b* such that said brush material 34*c* is disposed in a moving path of the feeding electrodes (f), (f) so that the surfaces of the feeding electrodes (f), (f) which engage with said binder can be cleaned upon movement of the feeding electrodes (f), (f).

Since the construction of this embodiment is otherwise the same as in the first preferred embodiment of the third invention, like members are designated by like reference numerals as in the first preferred embodiment of the third invention and their description is omitted.

Fourth Preferred Embodiment of the Third Invention

Figure 14:
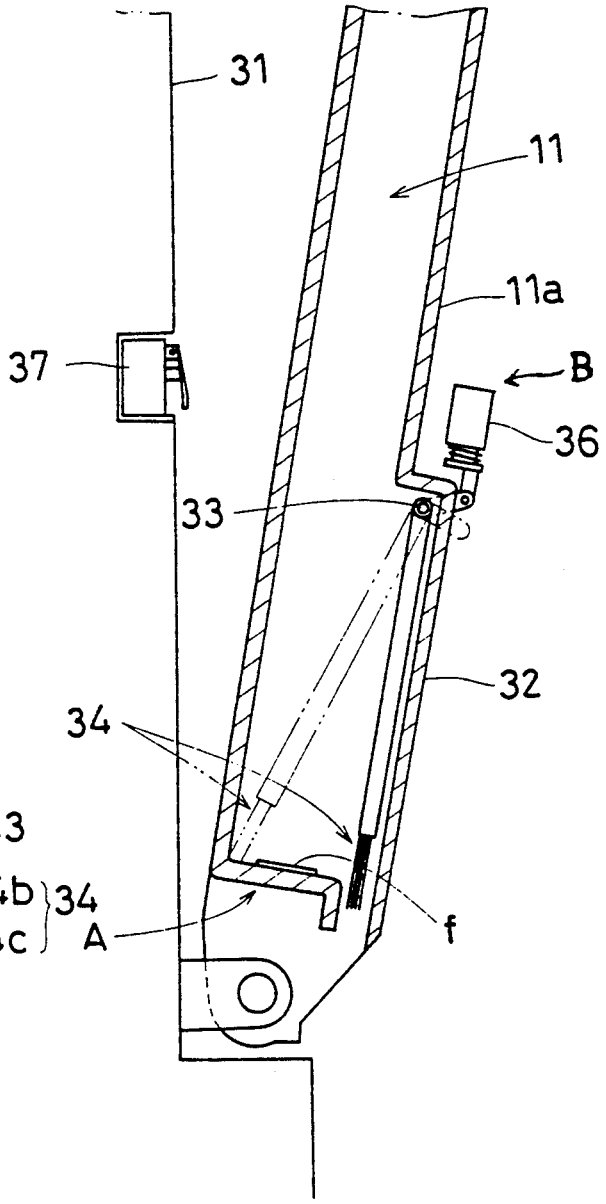
FIG. 14 is a sectional view showing main parts of a bookbinding device according to a fourth preferred embodiment of the third invention.

FIG. 14 shows a cleaning device A and an operating device B according to a fourth preferred embodiment of the third invention. In this preferred embodiment, a cover 31 (see FIG. 10) is provided with a binder-charged portion 11 pivotally mounted on a lower portion thereof so that said binder-charged portion 11 can be moved between a using condition in which it extends away from the front of said cover 31 and a non-using condition in which it extends along the cover 3I. The cleaning means A is provided for cleaning feeding electrodes (f), (f) and the operating means B is provided for operating said cleaning means A.

The cleaning means A is adapted to be automatically operated upon movement of said binder-charged portion 11 into said using condition during a bookbinding operation.

That is, as shown in FIG. 14, the fourth preferred embodiment of the third invention is characterized in that the binder-charged portion 11 is provided with an expanded portion 32 of a front wall portion 11*a* at a bottom portion thereof. The expanded portion 32 is provided with a brush (one example of a cleaning means) 34 movable between a bookbinding position and a retracted position retracted from the binder-charged portion 11 to define the cleaning means A for cleaning surfaces of the feeding electrodes (f), (f) by a vibration of said brush 34 of the binder-charged portion 11. A solenoid 36 is provided on a front for regularly and oppositely driving a shaft 33 to operate the brush 34, and a sensor 37 is provided on a housing 2 for detecting when the binder-charged portion 11 is in the using condition to operate said solenoid 36 so that said surfaces of the feeding electrodes (f), (f) which engage with said binder can be automatically cleaned when the binder-charged portion 11 is moved to the using condition during said bookbinding operation.

Since the construction of this embodiment is otherwise the same as in the first preferred embodiment of the third invention, like members are designated by like reference numerals as in the first preferred embodiment of the third invention and their description is omitted.

Fifth Preferred Embodiment of the Third Invention

Figure 15A:
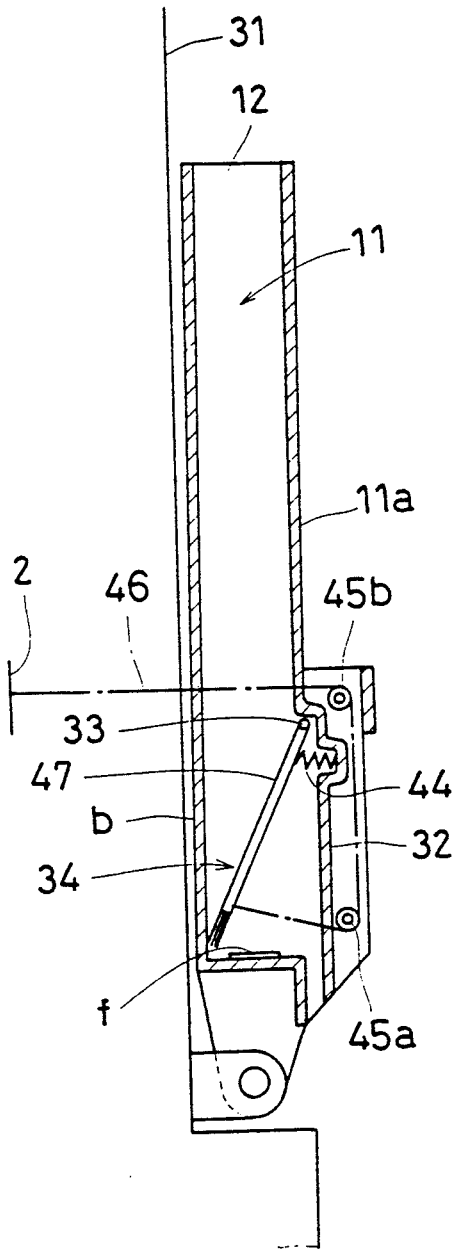
FIGS. 15(A) and (B) are sectional views showing main parts of a bookbinding device according to a fifth preferred embodiment of the third invention.
Figure 15B:
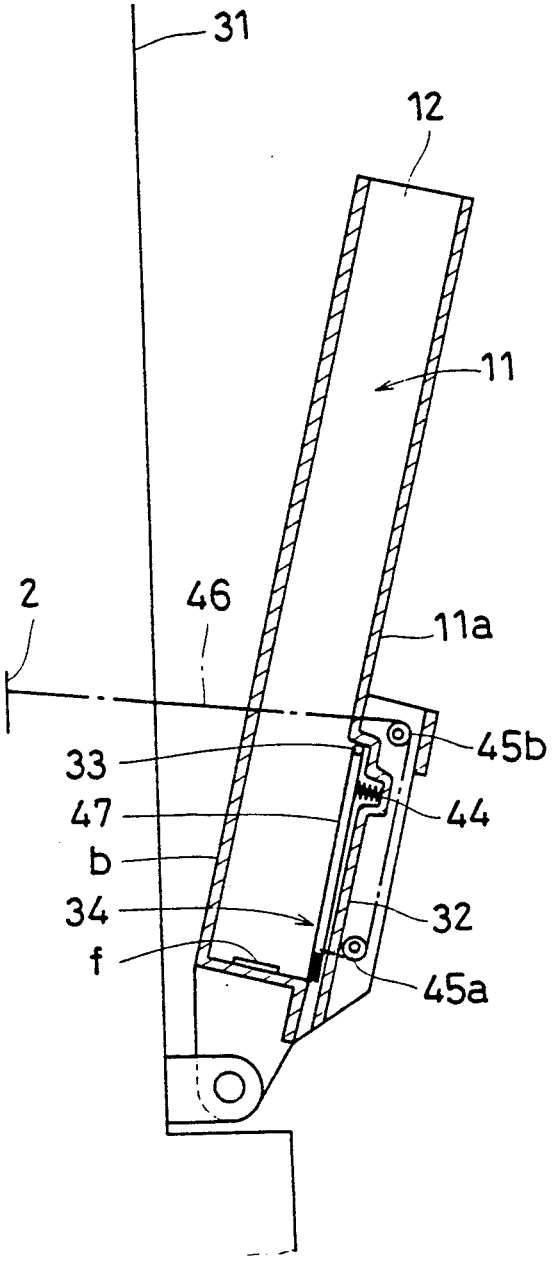

FIGS. 15(A) and (B) show the cleaning device A and the operating device B according to a fifth preferred embodiment of the third invention. In this preferred embodiment, a front cover 31 (see FIG. 10) is provided with a binder-charged portion 11 pivotally mounted on a lower portion thereof so that said binder-charged portion 11 can be moved between a using condition in which it is extended forwardly of said front cover 31 and a non-using condition in which it is extended along the front cover 31. The binder-charged portion 11 is provided with an expanded portion 32 in a bottom of a front wall portion 11*a*, as shown in FIG. 15. The expanded portion 32 is provided with a brush (one example of a cleaning means) 34 movable between a bookbinding position and a retracted position retracted from the binder-charge portion 11 to define the cleaning means A for cleaning surfaces of the feeding electrodes (f), (f) by swinging said brush 34. A spring 44 is provided for biasing the brush 34 toward the rear wall portion 11*b*.

This preferred embodiment is further characterized in that a wire 46 is trained around two pulleys 45*a*, 45*b* provided outside of the binder-charged portion 11, and is connected between an arm 47 connected with a shaft 33 and a housing 2 so that said wire 46 is pulled. The binder-charged portion 11 is pivoted to said using condition. Such pulling of the wire 46 causes the brush 34 to swing into its retracted position against the bias of said spring 44, thereby cleaning said surfaces of said feeding electrodes (f), (f) during said swing of the brush 34.

Since construction of this embodiment is otherwise the same as in the first preferred embodiment of the third invention, like members are designated by like reference numerals as in the first preferred embodiment of the third invention and their description is omitted.

Sixth Preferred Embodiment of the Third Invention

Figure 16:
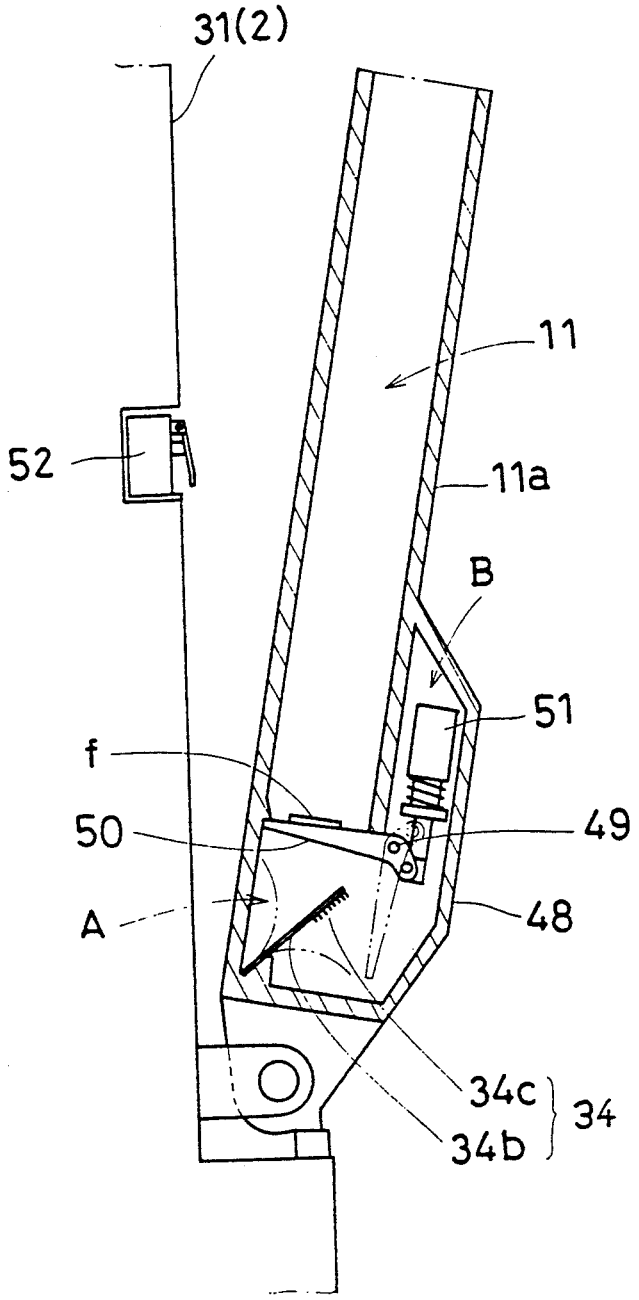
FIG. 16 is a sectional view showing main parts of a bookbinding device according to a sixth preferred embodiment of the third invention.

FIG. 16 shows the cleaning device A and the operating device B according to a sixth preferred embodiment of the third invention. In this preferred embodiment, a front cover 31 is provided with a binder-charged portion 11 pivotally mounted on a lower portion thereof so that said binder-charged portion 11 can be moved between a using condition in which it is extended forwardly from said front cover 31 and a non-using condition in which it is extended along the front cover 31. The binder-charged portion 11 is provided with an expanded portion 48 of a front wall portion 11*a* at a lower portion thereof. The expanded portion 48 is provided with an electrode-supporting member 50 swingable around a shaft 49. The electrode-supporting member 50 is provided with feeding electrodes (f), (f) arranged on an upper surface thereof so that said feeding electrodes (f), (f) can be pivoted between a bookbinding position (shown by a solid line) and a retracted position retracted from the binder-charged portion 11 (shown by a phantom line).

A brush 34, comprising a plate spring 34b and a brush material 34*c* mounted on a lower surface of said plate spring 34*b*, is provided on a lower portion of the binder-charged portion 11, such that said brush material 34*c* is in a moving path of the feeding electrodes (f), (f) to define cleaning means A for cleaning the surfaces of the feeding electrodes (f), (f) upon movement of the feeding electrodes (f), (f).

In addition, this preferred embodiment is characterized in that a solenoid 51, for regularly and oppositely driving said shaft 49 to operate the brush 34, is provided on the side of the binder-charged portion 11, and a sensor 52, for detecting movement of the binder-charged portion 11 to said using condition and to operate said solenoid 51 is provided on the side of said housing 2 so that the feeding electrodes (f), (f) can be automatically pivoted to said bookbinding position when the binder-charged portion 11 is moved to the using condition and the surfaces of the feeding electrodes (f), (f) can be cleaned by means of the brush 34 during the bookbinding operation.

Since the construction of this embodiment is otherwise the same as in the first preferred embodiment of the third invention, like members are designated by like reference numerals as in the first preferred embodiment of the third invention and their description is omitted.

Seventh Preferred Embodiment of the Third Invention

Figure 17A:
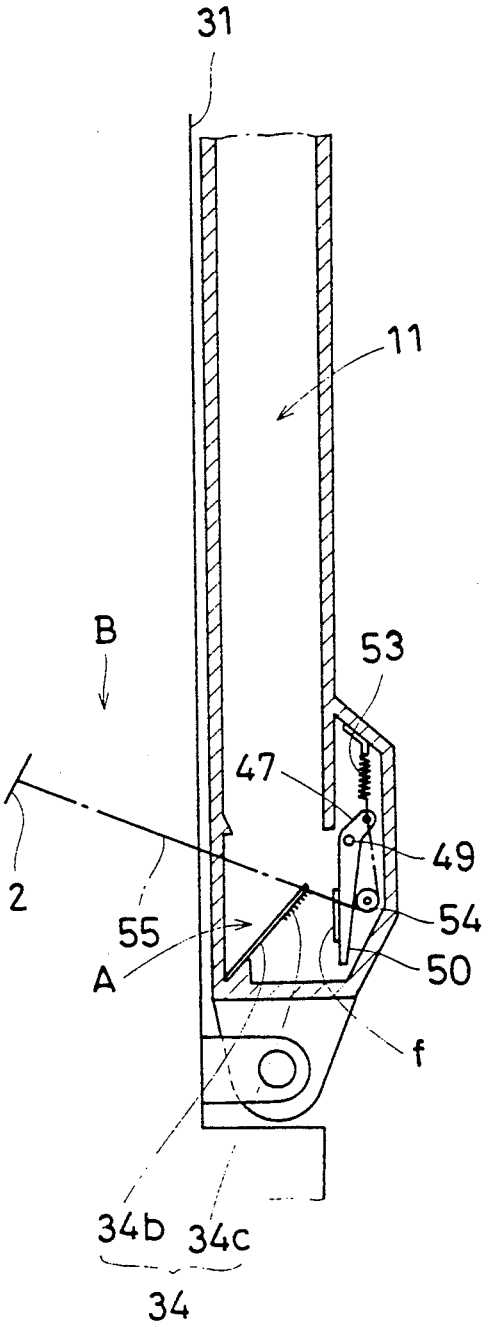
FIGS. 17(A) and (B) show a sectional view showing main parts of a bookbinding device according to a seventh preferred embodiment of the third invention.
Figure 17B:
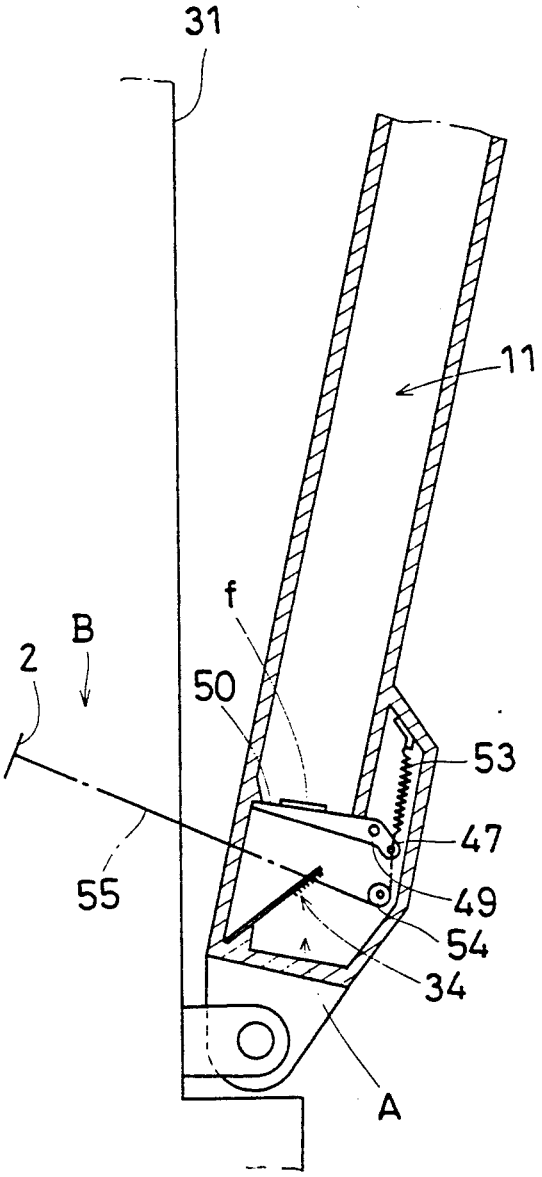

FIGS. 17(A) and (B) show the cleaning device A and the operating device B according to a seventh preferred embodiment of the third invention. This preferred embodiment is similar to the preceding sixth preferred embodiment of the third invention in that a binder-charged portion 11 includes an electrode-supporting member 50 adapted to be pivoted about a shaft 49 between a using condition and a non-using condition. Feeding electrodes (f), (f) are provided on an upper surface of the electrode-supporting member 50 so that said feeding electrodes (f), (f) which engage with a binder can be moved between a bookbinding position and a retracted position retracted from the binder-charged portion 11. A brush 34, comprising a plate spring 34b and a brush material 34*c* mounted on a lower surface of said plate spring 34*b*, is provided in a lower portion of the binder-charged portion 11 with the brush material 34*c* being disposed a moving path of the feeding electrodes (f), (f) so that said surfaces of the feeding electrodes (f) (f) which engage with said binder are cleaned upon movement of the feeding electrodes (f), (f). However, this embodiment is different from the sixth preferred embodiment of the third invention in that the means B for cleaning the surfaces of the feeding electrodes (f), (f) has the following construction.

That is, the means B for cleaning the surfaces of the feeding electrodes (f), (f) is characterized in that a spring 53 is provided for biasing the electrode-supporting member toward the retracted position. A pulley 54 is provided outside of the binder-charged portion 11, and a wire 55 is trained about said pulley 54 and connected between an arm 47 of the electrode-supporting member 50 and a housing 2. The wire 55 is pulled by movement of said shaft 49 of the feeding electrodes (f), (f) resulting from a change-over of the binder-charged portion 11 to said using condition so that the supporting member 50 and the feeding electrodes (f), (f) are moved to said bookbinding position against the bias of said spring 53, and such that the surfaces of the feeding electrodes (f), (f) are cleaned by means of said brush 34 during movement of the feeding electrodes (f), (f) to the bookbinding position.

In addition, in the above described third, fifth and seventh preferred embodiments, although not shown, a cleaning mode, in which the brush 34 and the feeding electrodes (f), (f) are moved in directions opposite to each other, can be adopted.

Eighth Preferred Embodiment of the Third Invention

Figure 18A:
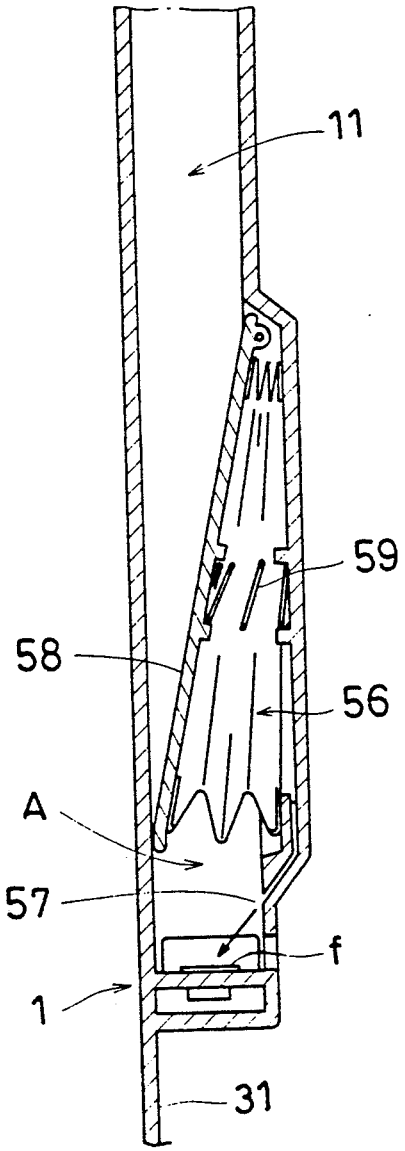
FIGS. 18(A) and (B) are sectional views showing main parts of a bookbinding device according to an eighth preferred embodiment of the third invention.

FIGS. 18(A) and (B) show the cleaning device A and the operating device B according to an eighth preferred embodiment of the third invention. This preferred embodiment is characterized in that the binder-charged portion 11 is provided with a bellows-like air pump 56 operated by being compressed by the binder (d) when the binder is inserted, and with a nozzle member 57 for blowing air from said air pump 56 to the feeding electrodes (f), (f), to define a cleaning means A therewithin. Reference numeral 58 designates a pressure-receiving movable plate member and reference numeral 59 designates a return spring of the air pump 56.

Figure 18B:
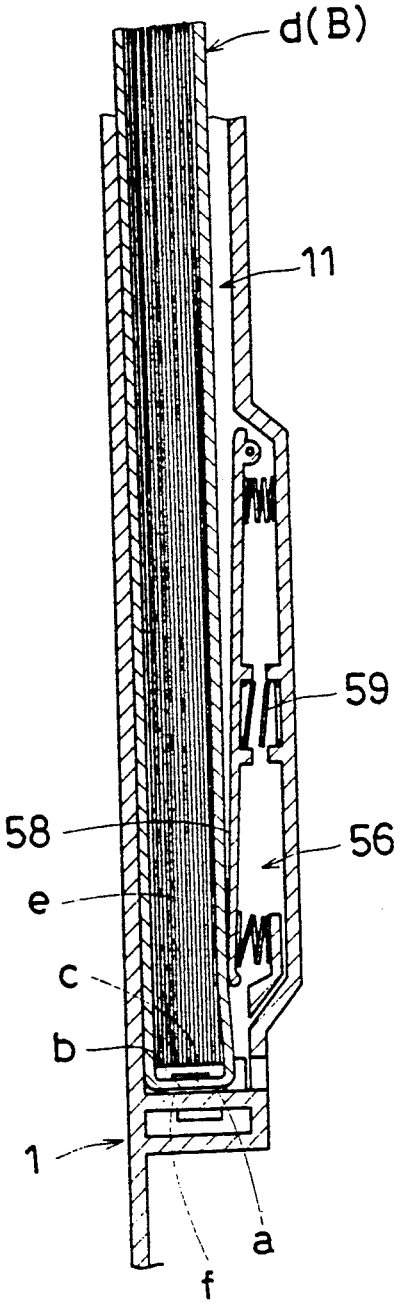

According to this preferred embodiment, foreign matter, such as paper dust, stuck to the feeding electrodes (f), (f) can be blown off by air pressure. The movable plate member 58 of the air pump 56 is biased outwardly by the spring 59 such that it presses against a lower end of the binder (d) as the binder (d) is inserted, as shown in FIG. 18(B), so that poor bookbinding resulting from insufficient pressure against the papers (e) can be effectively prevented.

Preferred Embodiment of the Fourth Invention

Figure 19A:
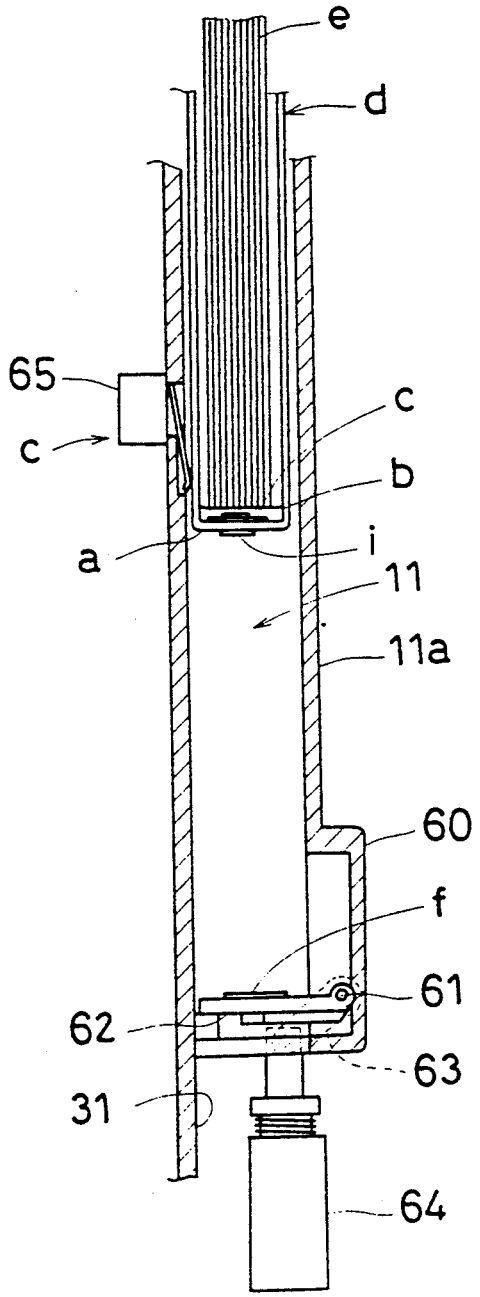
FIGS. 19(A) and (B) are sectional views showing main parts of a bookbinding device according to a fourth invention.
Figure 19B:
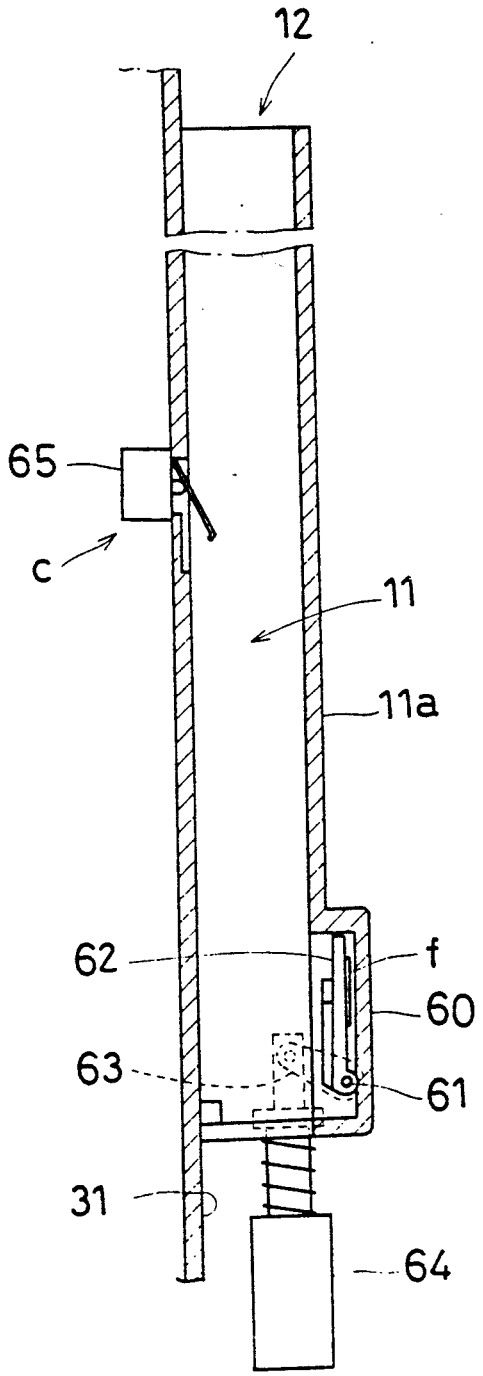

FIGS. 19(A) and (B) show a bookbinding device 1 according to a first preferred embodiment of the fourth invention. In said bookbinding device 1 according to this preferred embodiment, a binder-charged portion 11, provided with feeding electrodes (f), (f) on an inner bottom portion thereof, is provided on an outer surface of a front cover 31, with a binder-inserting hole 12 thereof facing upwardly. The feeding electrodes (f), (f) are adapted to be moved to a bookbinding position in which surfaces of the feeding electrodes (f), (f) face toward said binder-inserting hole 12, as shown in FIG. 19(A), and a retracted positioning which said surfaces of the feeding electrodes (f), (f) are shifted out of communication with the binder-inserting hole 12 (i.e. retracted from the binder-charged portion 11), as shown in FIG. 19(B). A means C is provided for automatically moving the feeding electrodes (f), (f) to said bookbinding position when the binder (d) is inserted into the binder-charged portion 11 during the bookbinding operation.

More specifically, the binder-charged portion 11 is provided with an expanded portion 60 formed on a front wall portion 11*a* near a bottom portion thereof, said expanded portion 60 being provided with a shaft 61 mounted to the side of a lower portion thereof. The shaft 61 is provided with electrode-supporting members 62 on both sides thereof, and said electrode-supporting members 62 are provided with the feeding electrodes (f), (f) mounted on an upper surface thereof to correspond with positions of electric current-receiving terminals (i), (i), respectively, so that the feeding electrodes (f), (f) can be moved between said bookbinding position and said masking (or retracted) position in which the feeding electrodes (f), (f) are housed in the expanded portion 60.

On the other hand, said operating means C comprises a link 63 mounted to one end of said shaft 61 which projects outwardly from the binder-charged portion 11, a solenoid 64 for regularly and oppositely driving the shaft 61 through said link 63 to move the surfaces of the feeding electrodes (f), (f) from the bookbinding position to the masking position, and a sensor 65 for detecting the insertion of the binder (d) into the binder-charged portion 11 and driving said solenoid 64.

According to the above described preferred embodiment, when no binder (d) is inserted in the binder-charged portion 11, the feeding electrodes (f), (f) are housed in the expanded portion 60, such that surfaces of the feeding electrodes (f), (f) are shifted away from communication with the binder-inserting hole 12. Thus, foreign matter, such as paper dust, can be prevented from being stuck to the surfaces of the feeding electrodes (f), (f) when no binder (d) is inserted in the binder-charged portion 11.

And, upon inserting the binder 9d) into the binder-charged portion 11, the presence of the binder (d) in the binder-charged portion 11 is detected by means of said sensor 65 to drive the solenoid 64. The solenoid 64 then causes the shaft 61 to be rotated to move the surfaces of the feeding electrodes (f), (f) to the bookbinding position.

And, said foreign matter, such as paper dust, can be prevented from being stuck to the surfaces of the feeding electrodes (f), (f) by positioning the feeding electrodes (f), (f) in the masking (or retracted) position. Thus, said electric current-receiving terminals (i), (i) of an electric heating member (c) can be brought into good contact with the feeding electrodes (f), (f) so that said electric heating member (c) can be heated in an appointed manner and an adhesive (b) can sufficiently heated and melted to adhere papers (e) to an inner surface of a back cover of the binder (d). Thus, the bookbinding is achieved If the cleaning means A according to, for example, the above described eighth preferred embodiment of the third invention (see FIGS. 18(A) and (B)), is added to the construction according to the first preferred embodiment of the fourth invention, the following operation and effects can be expected.

That is, since the surfaces of the feeding electrodes (f), (f) are positioned at the masking position when no bookbinding operation is in progress, foreign matter can be prevented from being stuck to the surfaces of the feeding electrodes (f), (f). However, even if foreign matter does become stuck to the surfaces of the feeding electrodes, when the feeding electrodes (f), (f) are moved to the bookbinding position, the surfaces of the feeding electrodes (f), (f) will be cleaned by the air pressure during insertion of the binder (d) into the binder-charged portion 11. Thus, good contact of the electric current-receiving terminals (i), (i) with the feeding electrodes (f), (f) is ensured.

In addition, although the feeding electrodes (f), (f) are moved between two positions by a driving force of the solenoid 64 in the above described preferred embodiment of the fourth invention, the movement of the feeding electrodes (f), (f) of the fourth invention can also be moved by pulling of wire as shown, for example, in FIGS. 15(A) and (B).

That is, the binder-charged portion 11 can be adapted to be moved between the using condition and the non-using condition, by having a wire connected between an electrode-supporting member 62 provided in the binder-charged portion 11 and a housing 2. With this arrangement, the feeding electrodes (f), (f) can be automatically moved to the bookbinding position when the binder-charged portion 11 is placed in the using condition (i.e. when the binder (d) is inserted into the binder-charged portion 11).

Furthermore, although insertion of the binder (d) into the binder-charged portion 11 is detected by means of the sensor 65 to drive the solenoid 64 in the above described fourth invention, the fourth invention can also be carried out in the manner shown in FIG. 16.

That is, the binder-charged portion 11 can be adapted to be pivoted between the using condition and the non-using condition, with a sensor being provided for detecting the using condition of the binder-charged portion 11. A solenoid 64 is driven on the basis of information from the sensor that the binder-charged portion 11 is in the using condition. Thus, the feeding electrodes (f), (f) are automatically moved to the bookbinding position upon movement of the binder-charged portion 11 to the using condition.

Figure 31A:
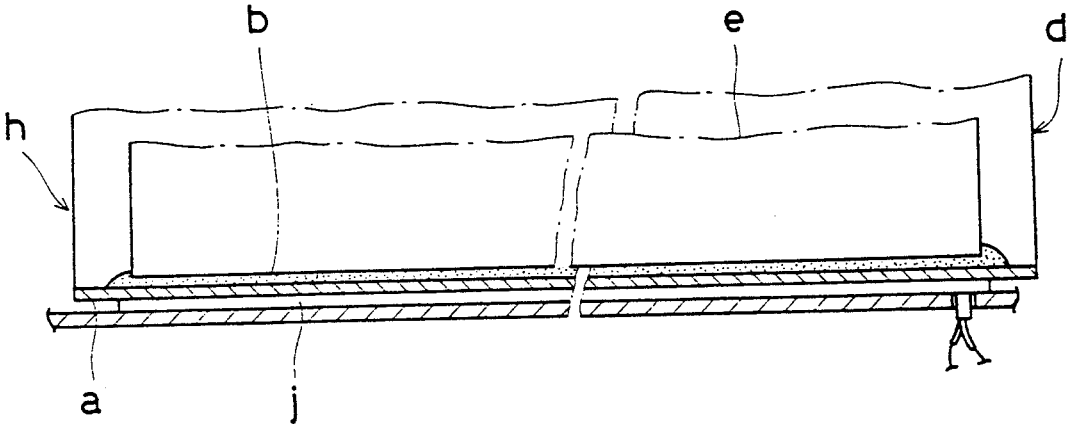
Fig. 31(A) (PRIOR ART)
FIGS. 31(A) and (B) are diagrams showing another conventional bookbinding device.
Figure 31B:
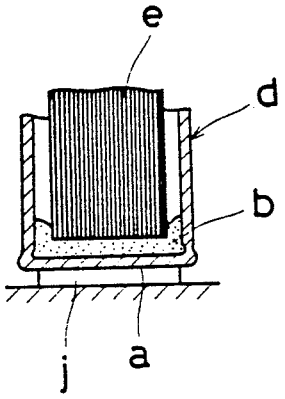
Fig. 31(B) (PRIOR ART)

Although in the above described respective preferred embodiments of the first to fourth inventions the bookbinding device 1 was only shown with the binder (d) being provided with the electric heating member (c) having the adhesive (b) and the binder-charged portion 11 being provided with the feeding electrode (f), (f) for electrifying the electric heating member (c) therewithin in the same manner as in the conventional example shown in FIG. 29 and FIGS. 30(A) and (B), this portion of the bookbinding device can be constructed in the same manner as the conventional example described with reference to FIGS. 31(A) and (B). In this case, one heat source (i), continuous over almost the entire length of the binder-charged portion 11, is provided in place of the illustrated pair of feeding electrodes (f), (f). Since the construction of this embodiment is otherwise substantially the same as in the above described respective preferred embodiment, further description thereof is omitted.

Preferred Embodiment of the Fifth Invention

Figure 20:
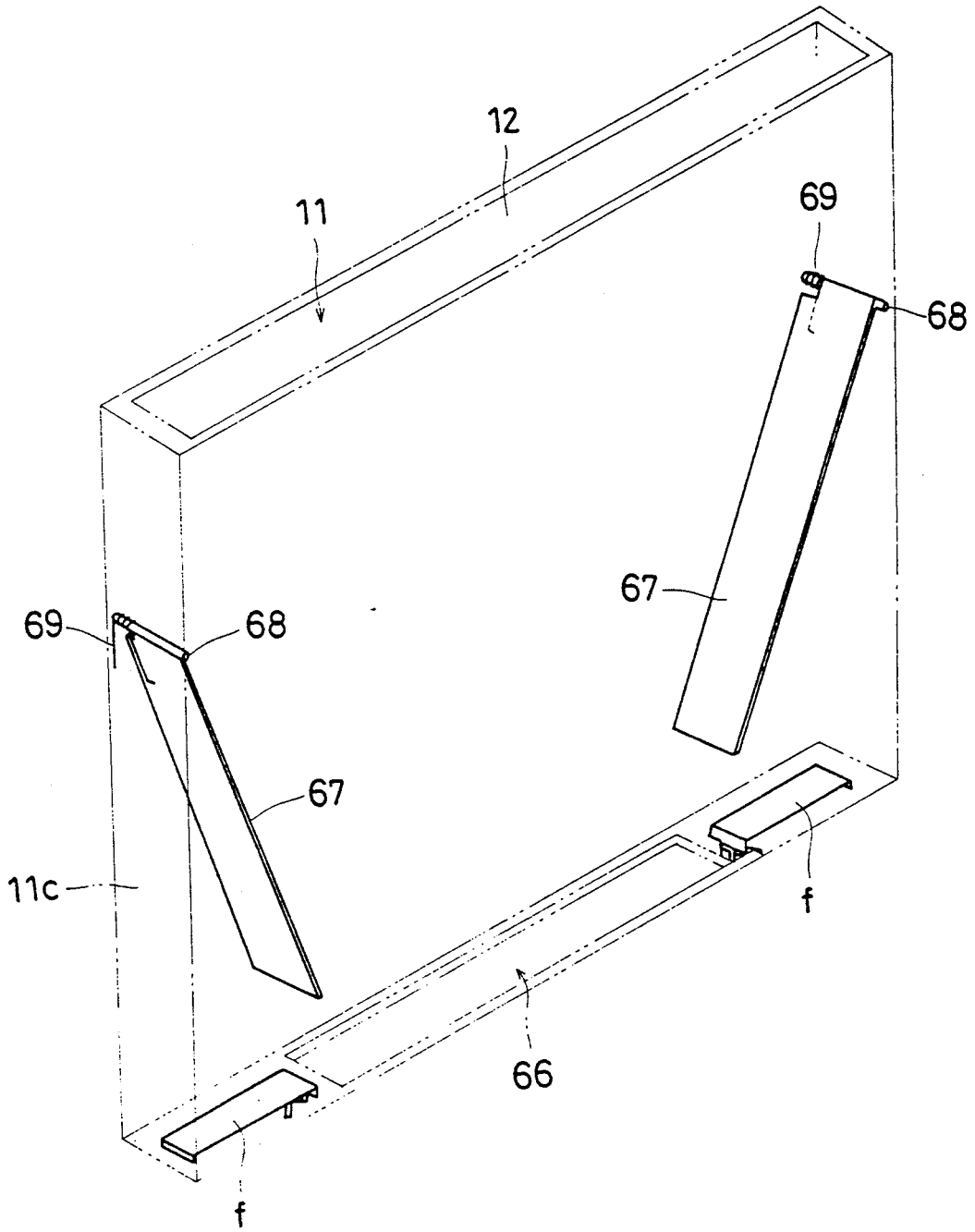
FIG. 20 is a perspective view showing main parts of a bookbinding device according to a fifth invention.
Figure 21:
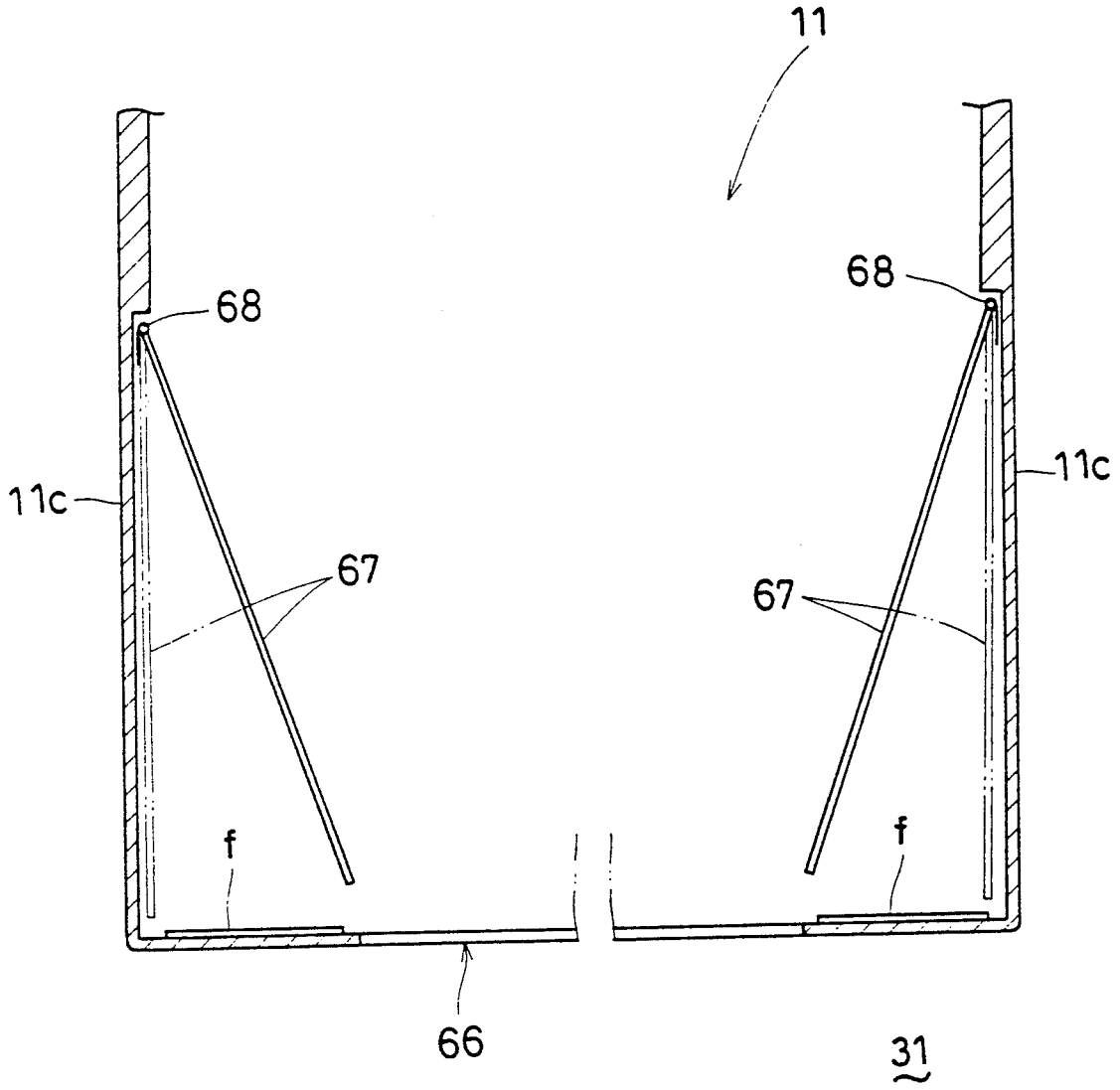
FIG. 21 is a sectional view showing the main parts shown in FIG. 20.

FIG. 20 and FIG. 21 show the bookbinding device 1 according to a preferred embodiment of the fifth invention. In the bookbinding device 1 according to this preferred embodiment, a front cover 31 (see FIG. 10) is provided with a binder-charged portion 11 provided with feeding electrodes (f), (f) on an inner bottom portion of an outer surface thereof with a binder-inserting hole 12 directed upwardly. The feeding electrodes (f), (f) are provided with a foreign matter-removal hole 66 formed in a bottom portion thereof between the feeding electrodes (f), (f), and said binder-charged portion 11 is provided therewithin with a pair of cover member 67, 67 for covering the feeding electrodes (f), (f).

Shafts 68 integrally formed at upper ends of said cover members 67, 67, respectively, are pivotally mounted on right and left wall portions 11*c* of the binder-charged portion 11 so that the cover members 67, 67 may be pivoted to a first posture in which they are disposed along an insertion path of a binder (d) and are tilted toward said foreign matter-removal hole 66, and a second posture in which the cover members are disposed against the walls 11*c*.

And, the shafts 68 are provided with coil springs 69 for biasing the cover members 67, 67 toward said first posture. Thus, the cover members 67, 67 can be automatically moved against the bias of spring 69 to said second posture by a pressing force of the binder (d) when the binder (d) is inserted in the binder-charged portion 11 during the bookbinding operation.

According to this preferred embodiment, foreign matter, such as paper dust, which has entered the binder-charged portion 11 through the binder-inserting hole 12, is guided toward the foreign matter-removal hole 66, by means of the tilted cover members 67, 67 covering the feeding electrodes (f), (f) on both sides and is discharged out of the binder-charged portion 11.

During the bookbinding operation, both end portions of a back cover (a) of the binder (d) press against the cover members 67, 67 when the binder (d) is inserted in the binder-charged portion 11, such that the cover members 67, 67 are pushed toward the second posture, in which they are disposed respectively against said right and left wall portions 11*c*, against the biasing force of said springs 69. Since the electric current-receiving terminals (i), (i) of an electric heating member (c) are brought into good contact with the feeding electrodes (f), (f), said electric heating member (c) is heated in an appointed manner and thus the adhesive (b) is sufficiently heated and melted to adhere the papers (e) to an inner surface of the binder (d), thereby completing the bookbinding process.

In addition, since the biasing forces of the springs 69 are balanced with each other, even if the binder (d) has a width smaller than that of the binder-charged portion 11, the binder (d) will be centered between the feeding electrodes (f), (f) by said biasing force of the springs 69 of the cover members 67, 67.

After the completion of the bookbinding operation, the cover members 67, 67 are returned to the original first posture by removal of the binder (d).

If the cleaning means A according to the first preferred embodiment of the third invention, as shown in, for example, FIG. 11, is added to the construction according to the preferred embodiment of the fifth invention, the following operation and effects can be expected.

That is, since the feeding electrodes (f), (f) are covered with the cover members 67, 67 when no bookbinding operation is in progress, foreign matter can be prevented from becoming stuck to surfaces of the feeding electrodes (f), (f), but even if foreign matter does become stuck to said surfaces of the feeding electrodes (f), (f), the surfaces of the feeding electrodes (f), (f) are cleaned during the bookbinding operation, when the binder (d) is inserted into the binder-charged portion 11 so that said electric current-receiving terminals (i), (i) are brought into good contact with the feeding electrodes (f), (f).

Alternatively, cleaning means (for example brushes and sponges) may be provided on lower ends of the cover members 67, to clean the surfaces of the feeding electrodes (f), (f) when the cover members 67, 67 are moved between two postures.

First Preferred Embodiment of the Sixth Invention

Figure 22:
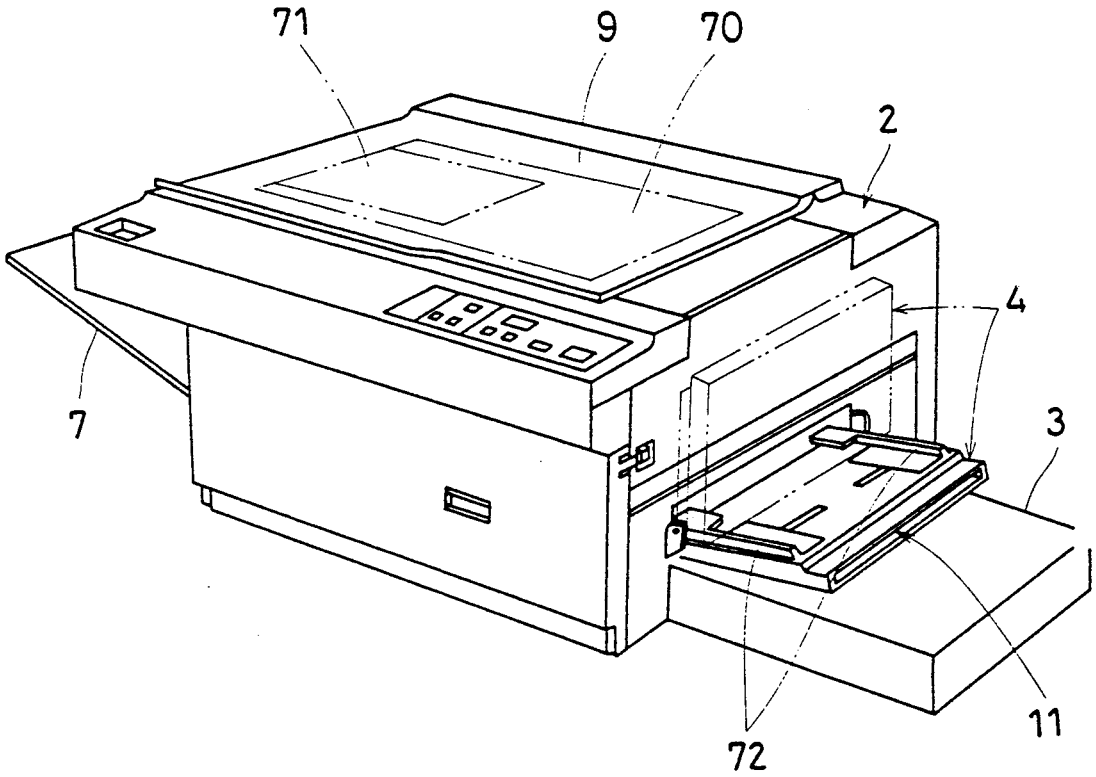
FIG. 22 is a perspective view showing the whole copying machine provided with a bookbinding device according to a first preferred embodiment of a sixth invention.
Figure 23:
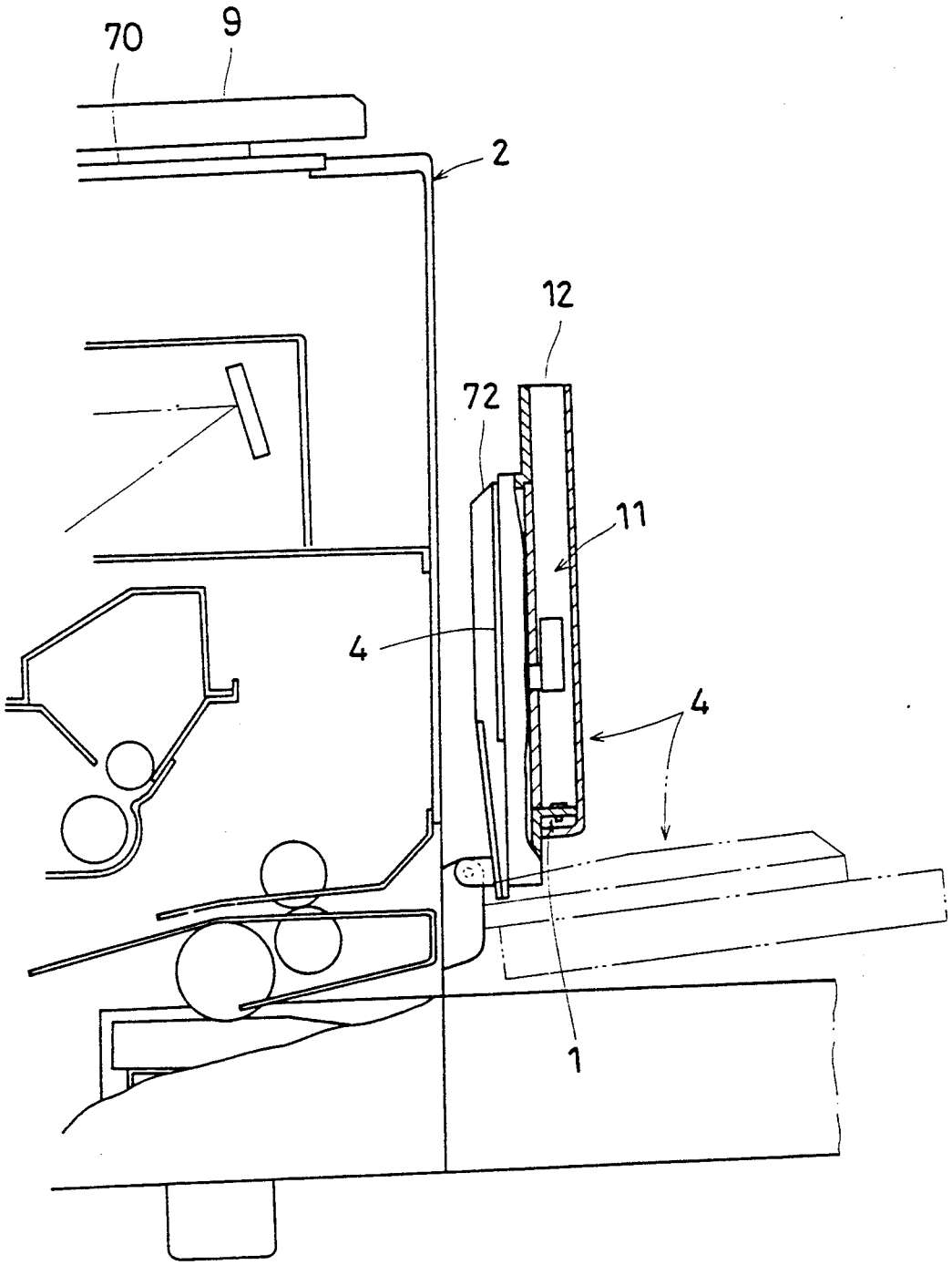
FIG. 23 is a sectional view showing main parts of the copying machine shown in FIG. 22.

FIG. 22 shows an electrostatic photographic copying machine as one example of an image-forming apparatus provided with a bookbinding device 1 according to a first preferred embodiment of the sixth invention. In this preferred embodiment, as shown in the fourth preferred embodiment of the first invention with reference to FIG. 7, and as also shown in FIG. 23, a housing is provided with a manual paper-supplying table 4 swingable around a shaft 26 so that said manual paper-supplying table 4 may be pivoted between a substantially horizontal paper-supplying posture (as shown by phantom line in FIG. 23) suitable for providing manual paper supply, and a vertical posture (as shown by solid line in FIG. 23), in which a binder-inserting hole 12 is directed upwardly, suitable for use in a bookbinding operation. The bookbinding device 1 is provided on an underside of the manual paper-supplying table 4.

The above described electrostatic photographic copying machine is a so-called center base paper supply machine, in which a center of a manuscript is made to coincide with a center of one end edge of a contact glass 70, and the manual paper-supplying table 4 is constructed to accommodate this center base paper supply mode.

Figure 24:
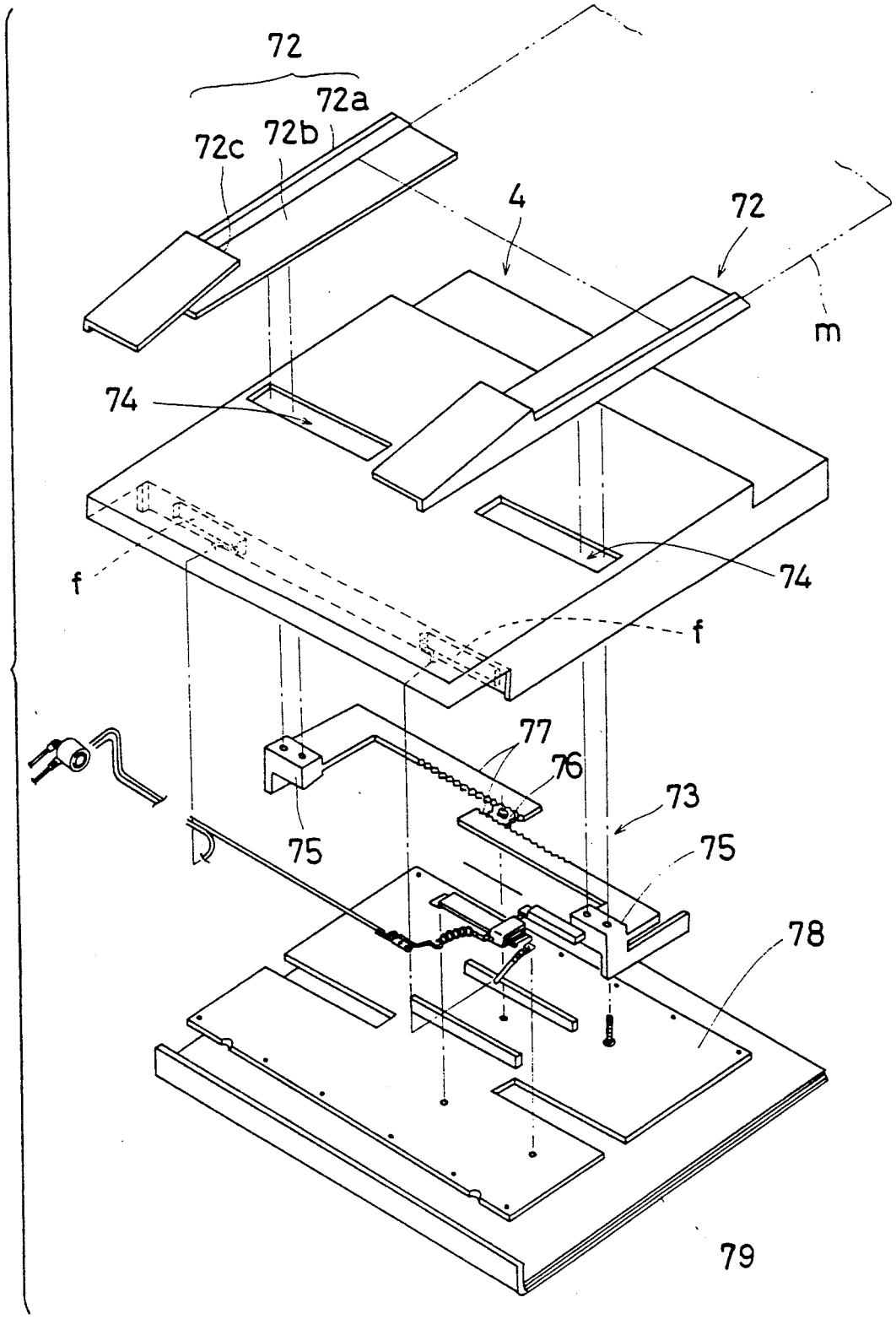
FIG. 24 is an exploded perspective view showing a manual paper-supplying table and a bookbinding device.

As shown in FIGS. 23 and 24, the manual paper-supplying table 4 is provided with a pair of paper guide means 72 for regulating positions of sides a paper (m) to be manually supplied and a guide adjustment mechanism 73 for adjusting the separation distance of said pair of paper guide means 72 depending upon the size of the paper.

In addition, the paper guide means 72 includes a side guide portion 72*a*, a paper carrying surface portion 72*b* and a paper hold-down portion 72*c*.

Figure 25:
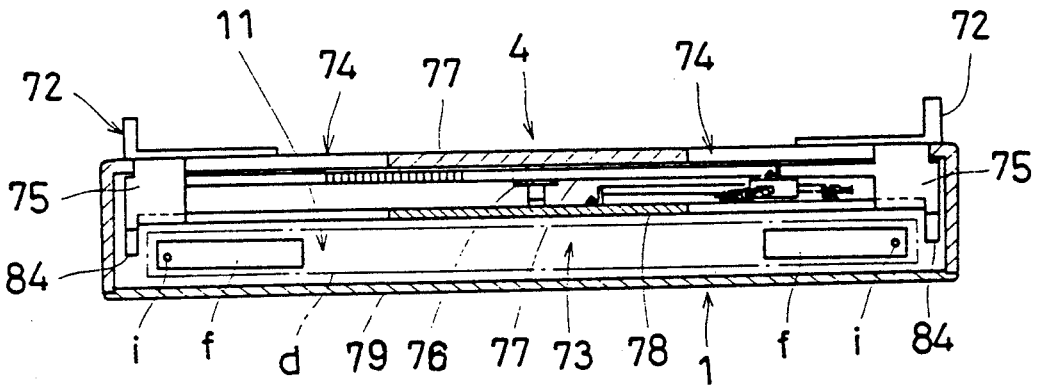
FIG. 25 is a sectional view showing main parts of the manual paper-supplying table and the bookbinding device of FIG. 24.
Figure 26:
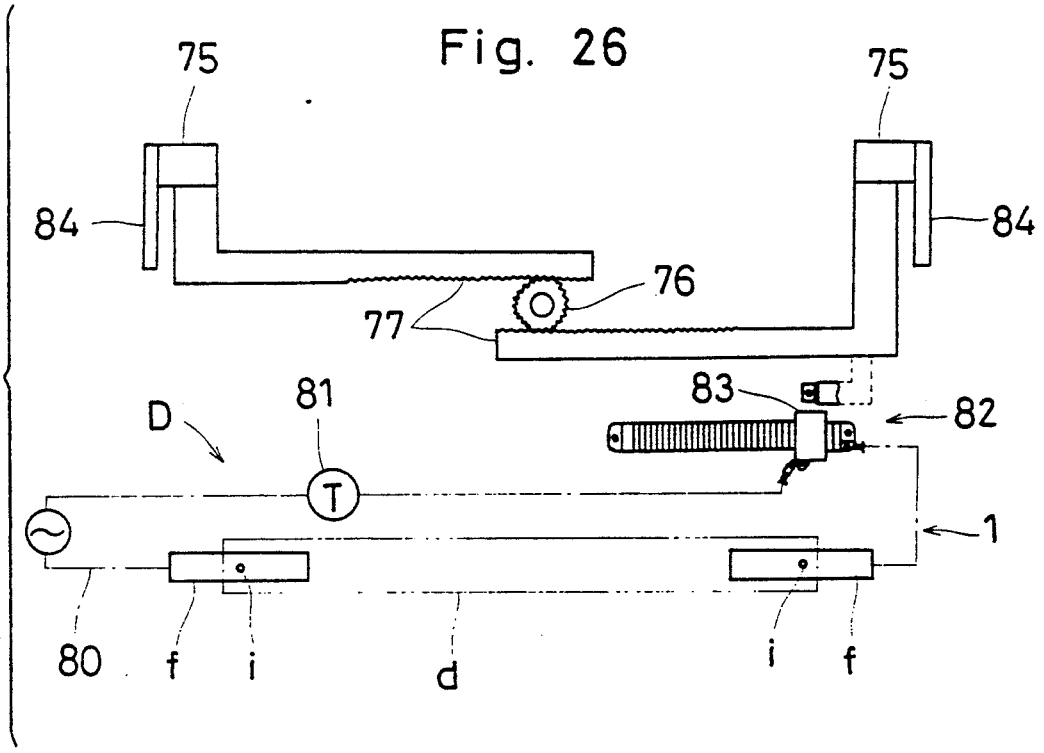
FIG. 26 is a block diagram showing electric current adjusting means.
Figure 27:
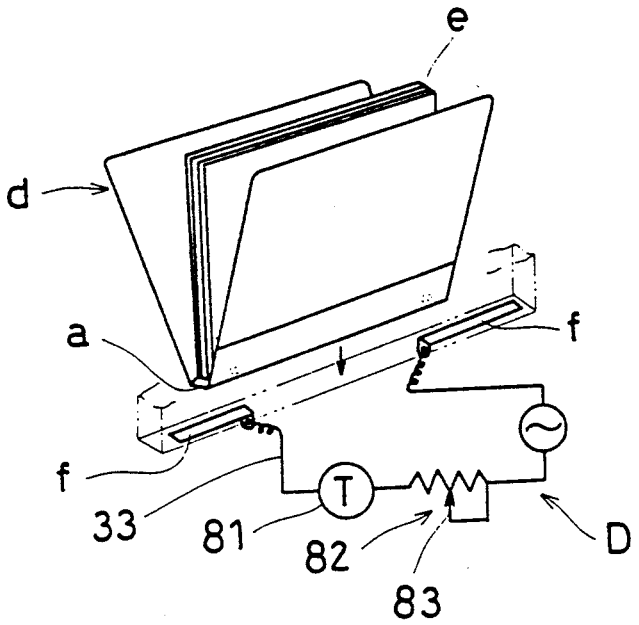
FIG. 27 is a diagram showing a form of the electric current adjusting means.

Said adjustment mechanism 73 has the following construction. That is, as shown also in FIG. 25, the manual paper-supplying table is provided with two openings 74, the paper guide means 72 being mounted on blocks 75 movable along said openings 74. A pinion 76 is rotatable around an axis normal to a plate surface of the manual paper-supplying table 4 and mounted at a central location in the direction of width on a back surface of the manual paper-supplying table 4. The blocks 75 have connected thereto racks 77 engaged with said pinion 76 on the upstream side and the downstream side in the paper-supplying direction. The manual paper-supplying table 4 is provided with a cover 78 for covering the adjustment mechanism 73.

In the bookbinding device 1, as shown in FIGS. 23 to 27, the manual paper-supplying table 4 is provided with a bottom plate 79 which defines a lower surface of a binder-charged portion 11 when the manual paper-supplying table 4 is in its substantially horizontal posture. The binder-charged portion 11 is provided with a pair of feeding electrodes (f), (f) for contracting electric current-receiving terminals (i), (i) of an electric heating member (c) and power setting means D for adjustably setting the amount electric power applied between said feeding electrodes (f), (f).

Said power setting means D comprises a circuit 80 for applying an electric current to the feeding electrodes (f), (f), a timer 81 for allowing the electric current to flow for a set time, a variable resistance means 82 for change a value of the electric current applied between said electric current-receiving terminals (i), (i), and a resistance value-setting member 83 for setting said variable resistance means 82. The setting member 83 is connected with one rack 77 (and thus with the paper guide means 72) so that said resistance may be reduced with an increase in the interval between said guide means 72. The racks 77 of the adjustment mechanism 73 and a position-regulating means 84 for regulating positions of sides of said binder (d) are connected with the blocks 75 so as to correspond in position to the paper guide means 72.

With the above described construction, upon changing the interval between the paper guide means 72 in dependence on the size of the papers (e) to the bound (and thus in dependence on the size of the binder (d)), said resistance value-setting member 83 of the variable resistance means 82 is moved to change said value of electric current flowing between the feeding electrodes (f), (f).

That is, the resistance value-setting member 83 is moved depending upon the size of the binder so that the resistance value of the variable resistance means may be reduced with an increase of the size of the binder (d) (and thus with an increase in the length and resistance of said electric heating member (c)). Likewise, the resistance value of the variable resistance means 82 may be increased with a reduction of the size of the binder (d) (and thus a reduction of the resistance value of the electric heating member (c)) to change the value of electric current flowing between the feeding electrodes (f), (f) (and to thus change the value of electric current applied between the electric current-receiving terminals (i), (i)).

And, if the resistance value-setting member 83 of the variable resistance means 82 is connected with one paper guide means (72), the sum of the resistance value of the electric heating member (c), which changes in dependence on the size of the binder (d), and the resistance value of the variable resistance means 82, which is automatically adjusted in dependence on the size of the binder (d), can always be maintained substantially constant when no electric loss is produced. Thus, the total calorific value, for a time set by means of said timer 81 per a unit length of the electric heating member (c), can be regulated so as to be almost constant for different sizes of the binder (d), and thus excessive heating an insufficient heating of the electric heating member (c) can be prevented.

In addition, although the resistance value-setting member 83 of the variable resistance means 82 is connected with one rack 77 in the above described preferred embodiment, a construction can be adopted in which a rotary operation-type resistance value-setting member 83 is used for the variable resistance means 82, the resistance value-setting member 8 being interlocking connected with the pinion 76 of the adjustment mechanism 73, and the setting member 83 being indirectly connected with the rack 77 and thus the paper guide means 72.

Alternatively, a construction can be adapted in which the power setting means D, for adjustably setting the amount of electric power applied, is provided with a binder size-selecting key. Size-selection information can be input in the variable resistance means 82 by operating said key, and an appointed electric current can be applied to the electric heating member (c) in dependence on the resistance value of the electric heating member (c), so that the total calorific value per unit length of the electric heating member (c) of the selected binder (d) can be maintained substantially constant.

Furthermore, although the calorific value of the electric heating member (c) is regulated by changing the value of electric current applied between the electric current-receiving terminals (i), (i), a regulating mode can be adapted in which a constant electric current is applied between the electric current-receiving terminals (i), (i) regardless of the change of resistance resulting from the change of the length the electric heating member (c). In this situation, a power source voltage in said electric current-applying circuit 80 can be changed to make the total calorific value per unit length of the electric heating member (c) almost constant.

Besides, although the so-called center base paper supply-type electrostatic photographic copying machine (one example of the image-forming apparatus), in which the center of the manuscript 71 is made to coincide with the center of one end edge in the paper-supplying direction of the contact glass 70, is described in the above described preferred embodiment, a construction can be adopted in which a so-called one end base paper supply-type image-forming apparatus is utilized. In this type of apparatus, two sides of the manuscript are made to coincide with one end edge in the paper-supplying direction of the contact glass and a side end edge adjustment to said one end edge in the paper-supplying direction of the contact glass. In this situation, the resistance value-setting member of the variable resistance means is connected with the guide means for guiding one side of the paper, which is provided on the manual paper-supplying table.

Second Preferred Embodiment of the Sixth Invention

Figure 28:
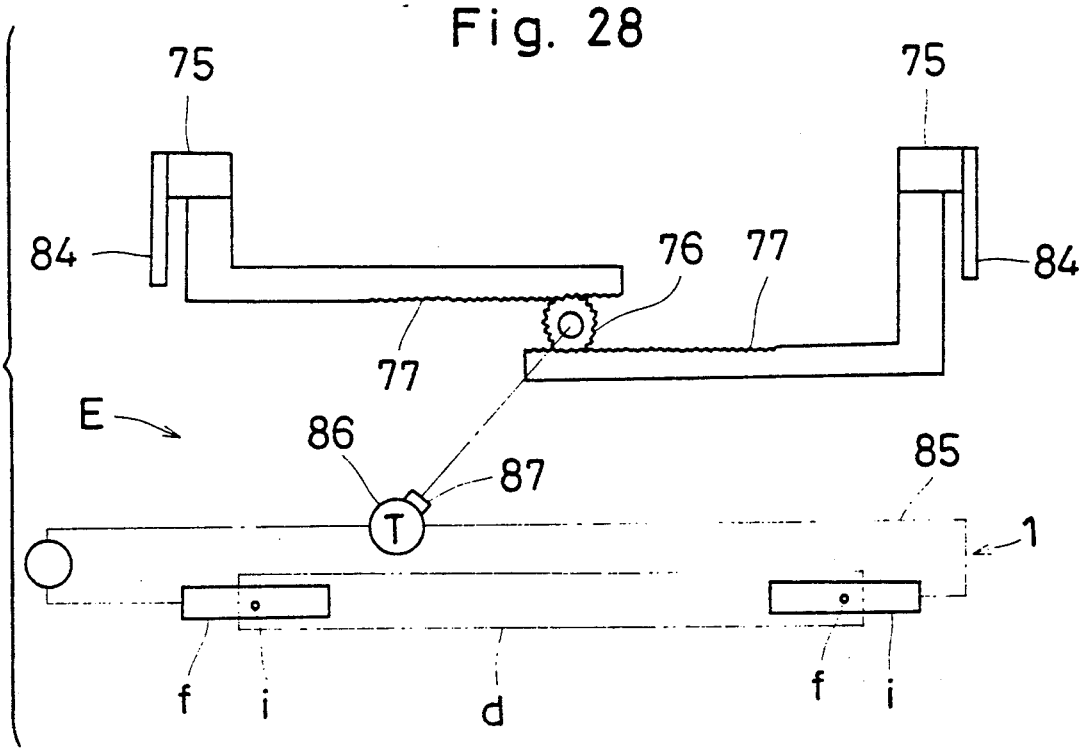
FIG. 28 is a block diagram showing an electric current adjusting means according to a second preferred embodiment of the sixth invention.

FIG. 28 shows a heating-control means E according to a second preferred embodiment of the sixth invention. This control means E is operable to apply a constant electric current between electric current-receiving terminals (i), (i) and for changing a time period for applying said constant electric current, in order to make the total calorific value per unit length of an electric heating member (c) almost constant. To this end, the control means E comprises a circuit 85 for applying a constant electric current between said electric current-receiving terminals (i), (i) of said electric heating member (c), a timer 86 for adjustably setting said time for applying said constant electric current to said circuit 85, and a time-setting member 87 of said timer 86. The control means E is operably connected with a pinion 76 of a guide adjustment mechanism 73 so that a calorific value per unit time (i.e. the above described time period set by means of the timer 86) of the electric heating member (c) may be regulated in dependence on the size of a binder (d) so as to be maintained substantially constant. That is, a voltage may be increased with an increase of said size of said binder (d), and thus of an increase of a resistance value of the electric heating member (c).

In addition, in the above described first and second preferred embodiments of the sixth invention, a cover 13 as shown, for example, in FIG. 7, may be provided.

Effects of the Invention

The present invention is constructed in accordance with the above described alternative constructions, so that the following effects are exhibited.

That is, according to the first to sixth inventions, since the function of the bookbinding device is added to the image-forming apparatus, respectively, the installation space is smaller than that in the case where the image-forming apparatus and the bookbinding device are separately provided, and the constituent members can be commonly used for both the image forming apparatus and the bookbinding device, so that an economic advantage can also be obtained.

In addition, in the first and second invention the binder-inserting hole is adapted to be closed when no bookbinding operation is in progress, so that foreign matter, such as paper dust, can be prevented from entering the binder-charged portion to prevent uneven heating and insufficient heating of the adhesive due to poor contact resulting from adherence of foreign matter on the surfaces of the heat source or the electrodes.

In the third invention, even if foreign matter enters the binder-charged portion and becomes stuck to the surfaces of the heat source or the electrodes when no bookbinding operation is in progress, the cleaning means is operated to clean the surface of the heat source or the electrodes, so that poor contact of the electric current-receiving terminals on the side of the binder with the surfaces of the heat source or the electrodes can be prevented. This prevents uneven heating and insufficient heating of the adhesive resulting from adherence of the foreign matter.

In the fourth invention, even if foreign matter enters the binder-charged portion when no bookbinding operation is in progress, the heat source or the electrodes are positioned at their masking (or retracted) position, so that foreign matter is unlikely to become stuck to the surfaces of the heat source or the electrodes. Accordingly, uneven heating and insufficient heating of the adhesive due to poor contact resulting from adherence of foreign matter can be prevented.

In the fifth invention, even if foreign matter enters the binder-charged portion, the foreign matter can be guided toward the foreign matter-removal hole, by means of the cover member, to be discharged out of the binder-charged portion, so that foreign matter can be prevented from sticking to the surfaces of the feeding electrodes to prevent insufficient heating of the adhesive due to poor contact of the electric heating member with the electric current-receiving terminals and the feeding electrodes.

In the sixth invention, the electric power applied between the feeding terminals or the time of applying the constant electric current is adjusted in dependence on the length of different sized binders to maintain the total calorific value per unit length of the electric heating member almost constant, so that excessive heating and insufficient heating of the electric heating member can be prevented.

That is, according to the first to sixth inventions, an economical and compact image-forming apparatus, provided with a bookbinding device capable of appropriately heating and melting an adhesive, can be provided.

What is claimed is:

1. A bookbinding device for an image-forming apparatus, comprising:

a binder receiving portion for receiving a binder having papers and an adhesive therein;

heating means for causing heating and melting of the adhesive in the binder when the binder is fully inserted in said binder receiving portion, said heating means comprising a contact element movably mounted in a bottom portion of said binder receiving portion for movement between a bookbinding position in which said contact element is adapted to be contacted by a contact portion of the binder, and a retracted position in which said contact element is positioned outside of an insertion path of the binder; and operating means for moving said contact element between said bookbinding position and said retracted position.

2. A bookbinding device as recited in claim 1, wherein said operating means is operable to move said contact element from said retracted position to said bookbinding position upon insertion of the binder into said binder receiving portion.

3. A bookbinding device as recited in claim 2, wherein said operating means comprises a solenoid operably connected to said contact element, and a sensor means for detecting insertion of the binder into said binder receiving portion and for causing operation of said solenoid upon detection of the insertion of the binder.

4. A bookbinding device as recited in claim 3, wherein said contact element is swingably mounted to said binder receiving portion.

* * * * *